US009280961B2

(12) United States Patent
Eronen et al.

(10) Patent No.: US 9,280,961 B2
(45) Date of Patent: Mar. 8, 2016

(54) AUDIO SIGNAL ANALYSIS FOR DOWNBEATS

(71) Applicant: Nokia Corporation, Espoo (FI)

(72) Inventors: Antti Johannes Eronen, Tampere (FI); Jussi Artturi Leppänen, Tampere (FI); Igor Danilo Diego Curcio, Tampere (FI)

(73) Assignee: Nokia Technologies Oy, Espoo (FI)

( * ) Notice: Subject to any disclaimer, the term of this patent is extended or adjusted under 35 U.S.C. 154(b) by 36 days.

(21) Appl. No.: 14/302,057

(22) Filed: Jun. 11, 2014

(65) Prior Publication Data

US 2014/0366710 A1 Dec. 18, 2014

(30) Foreign Application Priority Data

Jun. 18, 2013 (GB) ..... 1310861

(51) Int. Cl.

*A63H 5/00* (2006.01)
*G04B 13/00* (2006.01)
*G10H 7/00* (2006.01)

(Continued)

(52) U.S. Cl.

CPC . *G10H 1/00* (2013.01); *G10H 1/40* (2013.01); *G10H 2210/061* (2013.01); *G10H 2210/071* (2013.01); *G10H 2210/076* (2013.01); *G10H 2210/341* (2013.01); *G10H 2240/251* (2013.01); *G10H 2250/135* (2013.01)

(58) Field of Classification Search

CPC ..... G10H 1/00; G10H 1/40; G10H 2210/341; G10H 2210/061; G10H 2210/071; G10H 2210/076; G10H 2240/251; G10H 2250/135

USPC ..... 84/609

See application file for complete search history.

(56) References Cited

U.S. PATENT DOCUMENTS 6,542,869 B1 4/2003 Foote
7,612,275 B2 11/2009 Seppanen et al.

(Continued)

FOREIGN PATENT DOCUMENTS

EP 1947638 A1 7/2008
WO 2013/164661 A1 11/2013
WO 2014/001849 A1 1/2014

OTHER PUBLICATIONS

Peeters et al., "Simultaneous Beat and Downbeat-Tracking Using a Probabilistic Framework: Theory and Large-Scale Evaluation", IEEE Transactions on Audio, Speech, and Language Processing, vol. 19, Issue 6, Aug. 2011, pp. 1754-1769.

(Continued)

*Primary Examiner* — Jeffrey Donels
(74) *Attorney, Agent, or Firm* — Nokia Technologies Oy

(57) ABSTRACT

Apparatus for audio processing comprises: a beat tracking module for identifying beat time instants in an audio signal and a downbeat identifier for identifying downbeats occurring at beat time instants, each downbeat corresponding to the start of a musical bar or measure. A pattern identifier identifies two or more adjacent bars or measures containing musical characteristics which repeat within the audio signal, the pattern identifier being configured to: generate for each downbeat a plurality of scores using respective analysis methods for indicating different characteristics within the audio signal at the downbeat; combine the scores for each downbeat; and identify based on the combined scores non-adjacent downbeats that correspond to the start of a musical pattern.

22 Claims, 19 Drawing Sheets

(51) Int. Cl.
*G10H 1/00* (2006.01)
*G10H 1/40* (2006.01)

(56) References Cited

U.S. PATENT DOCUMENTS

| | | | | |
|---|---|---|---|---|
| 7,659,471 | B2 | 2/2010 | Eronen | |
| 8,440,901 | B2 * | 5/2013 | Nakadai et al. | 84/612 |
| 2003/0205124 | A1 * | 11/2003 | Foote et al. | 84/608 |
| 2007/0261537 | A1 | 11/2007 | Eronen et al. | |
| 2007/0291958 | A1 * | 12/2007 | Jehan | 381/103 |
| 2008/0236371 | A1 * | 10/2008 | Eronen | 84/622 |
| 2010/0188580 | A1 * | 7/2010 | Paschalakis et al. | 348/571 |
| 2011/0255700 | A1 * | 10/2011 | Maxwell et al. | 381/58 |
| 2014/0060287 | A1 * | 3/2014 | Okuda | 84/612 |
| 2015/0094835 | A1 * | 4/2015 | Eronen et al. | 700/94 |

OTHER PUBLICATIONS

Eronen et al., "Music Tempo Estimation with k-NN Regression", IEEE Transactions on Audio, Speech, and Language Processing, vol. 18, Issue 1, Jan. 2010, pp. 50-57.

Seppanen et al., "Joint Beat & Tatum Tracking from Music Signals", In Proceedings of the 7th International Conference on Music Information Retrieval, Oct. 8-12, 2006, 6 pages.

Klapuri et al., "Analysis of the Meter of Acoustic Musical Signals", IEEE Transactions on Audio, Speech, and Language Processing, vol. 14, Issue 1, Jan. 2006, pp. 1-14.

Jehan, "Creating Music by Listening", PhD Thesis, MIT, 2005, pp. 1-137.

Mauch et al., "Using Musical Structure to Enhance Automatic Chord Transcription", Proceedings of the 10th International Society for Music Information Retrieval Conference, Oct. 26-30, 2009, pp. 231-236.

Cooper et al., "Summarizing Popular Music via Structural Similarity Analysis", IEEE Workshop on Applications of Signal Processing to Audio and Acoustics, Oct. 19-22, 2003, 4 pages.

Paulus et al., "Music Structure Analysis Using a Probabilistic Fitness Measure and an Integrated Musicological Model", In Proceedings of the 9th International Conference on Music Information Retrieval, Sep. 14-18, 2008, pp. 369-374.

Foote, "Automatic Audio Segmentation Using a measure of Audio Novelty", IEEE International Conference on Multimedia and Expo, vol. 1, Jul. 30-Aug. 2, 2000, 4 pages.

Office action received for corresponding United Kingdom Patent Application No. 1310861.8, dated Nov. 29, 2013, 8 pages.

Ellis, "Beat Tracking by Dynamic Programming", Journal of New Music Research, vol. 36, Issue 1, Special Issue: Algorithms for Beat Tracking and Tempo Extraction, Mar. 2007, pp. 51-60.

Extended European Search Report received for corresponding European Patent Application No. 14172049.0, dated Nov. 12, 2014, 7 Pages.

* cited by examiner

AUDIO SIGNAL ANALYSIS FOR DOWNBEATS

FIELD OF THE INVENTION

This invention relates to audio signal analysis and particularly to music meter analysis and the detecting of patterns in music.

BACKGROUND OF THE INVENTION

Patterns occur in many forms of music. Musical patterns can be considered as groups of musical measures (also known as bars), for example two adjacent measures, which have musical characteristics that repeat within the overall musical piece. Often, melodic or harmonic phrases in popular music have the duration corresponding to a musical pattern, such as two measures, with repetitions in the signal between segments that are the length of the music pattern.

There are a number of practical applications in which it is desirable to identify such musical patterns from a musical audio signal.

A particularly useful application is to help synchronise automatic video scene cuts to musically meaningful points. For example, where multiple video (with audio) clips are acquired from different sources relating to the same musical performance, it would be desirable to automatically join clips from the different sources and provide switches between the video clips in an aesthetically pleasing manner, resembling the way professional music videos are created. One method already proposed by the Applicant is to detect downbeats from the music, that is the first beat of each measure, and to make switches on downbeats. This specification improves on this concept. It has been observed that for many songs in 4/4 time signature, one can count to eight while listening to the music, indicating a pattern consisting of two adjacent 4/4 measures; Applicant has determined that switching on the first beat of such eight beat patterns, at least more often than for other beats, produces a particularly professional-looking video edit.

The same concept applies to other time measures and groupings of measures, although this specification concentrates on adjacent 4/4 measures. Other practical applications are also mentioned later as alternatives to automating video scene cuts.

The following terms are useful for understanding certain concepts to be described later.

Pitch: the physiological correlate of the fundamental frequency ($f_0$) of a note.

Chroma, also known as pitch class: musical pitches separated by an integer number of octaves belong to a common pitch class. In Western music, twelve pitch classes are used.

Beat or tactus: the basic unit of time in music, it can be considered the rate at which most people would tap their foot on the floor when listening to a piece of music. The word is also used to denote part of the music belonging to a single beat.

Tempo: the rate of the beat or tactus pulse represented in units of beats per minute (BPM).

Bar or measure: a segment of time defined as a given number of beats of given duration. For example, in music with a 4/4 time signature, each measure comprises four beats.

Downbeat: the first beat of a bar or measure.

Music pattern: groupings of musical measures. As an example, the music pattern may correspond to a group of two adjacent measures. Often, melodic or harmonic phrases in popular music have the duration corresponding to a music pattern, such as two measures. In this case, there will be repetitions in the signal between segments that are of the length or the music pattern.

Music structure: structures or musical forms in popular music are typically in sectional, repeating forms. Examples include the verse-chorus form common in pop music and the twelve-bar form of blues music.

Accent or Accent-based audio analysis: analysis of an audio signal to detect events and/or changes in music, including but not limited to the beginning of all discrete sound events, especially the onset of long pitched sounds, sudden changes in loudness of timbre, and harmonic changes.

As will be appreciated, human perception of musical meter involves inferring a regular pattern of pulses from moments of musical stress, a.k.a. accents. Accents are caused by various events in the music, including the beginnings of all discrete sound events, especially the onsets of long pitched sounds, sudden changes in loudness or timbre, and harmonic changes. Automatic tempo, beat, or downbeat estimators may try to imitate the human perception of music meter to some extent, by measuring musical accentuation, estimating the periods and phases of the underlying pulses, and choosing the level corresponding to the tempo or some other metrical level of interest. Since accents relate to events in music, accent based audio analysis refers to the detection of events and/or changes in music. Such changes may relate to changes in the loudness, spectrum, and/or pitch content of the signal. As an example, accent based analysis may relate to detecting spectral change from the signal, calculating a novelty or an onset detection function from the signal, detecting discrete onsets from the signal, or detecting changes in pitch and/or harmonic content of the signal, for example, using chroma features. When performing the spectral change detection, various transforms or filterbank decompositions may be used, such as the Fast Fourier Transform or multirate filterbanks, or even fundamental frequency f0 or pitch salience estimators. As a simple example, accent detection might be performed by calculating the short-time energy of the signal over a set of frequency bands in short frames over the signal, and then calculating difference, such as the Euclidean distance, between every two adjacent frames. To increase the robustness for various music types, many different accent signal analysis methods have been developed.

The systems and methods to be described hereafter draw on background knowledge described in the following publications which are incorporated herein by reference.

[1] Peeters and Papadopoulos, "Simultaneous Beat and Downbeat-Tracking Using a Probabilistic Framework: Theory and Large-Scale Evaluation"., "IEEE Trans. Audio, Speech and Language Processing, Vol. 19, No. 6, August 2011.

[2] Eronen, A. and Klapuri, A., "Music Tempo Estimation with k-NN regression," IEEE Trans. Audio, Speech and Language Processing, Vol. 18, No. 1, January 2010.

[3] Seppänen, Eronen, Hiipakka. "Joint Beat & Tatum Tracking from Music Signals", International Conference on Music Information Retrieval, ISMIR 2006 and Jarno Seppänen, Antti Eronen, Jarmo Hiipakka: Method, apparatus and computer program product for providing rhythm information from an audio signal. Nokia November 2009: U.S. Pat. No. 7,612,275.

[4] Antti Eronen and Timo Kosonen, "Creating and sharing variations of a music file"—United States Patent Application 20070261537.

[5] Klapuri, A., Eronen, A., Astola, J., "Analysis of the meter of acoustic musical signals," IEEE Trans. Audio, Speech, and Language Processing, Vol. 14, No. 1, 2006.

[6] Jehan, Creating Music by Listening, PhD Thesis, MIT, 2005. http://web.media.mit.edu/~tristan/phd/pdf/Tristan_PhD_MIT.pdf

[7] D. Ellis, "Beat Tracking by Dynamic Programming", J. New Music Research, Special Issue on Beat and Tempo Extraction, vol. 36 no. 1, March 2007, pp. 51-60. (10pp) DOI: 10.1080/09298210701653344.

[8] Matthias Mauch, Katy Noland, Simon Dixon "USING MUSICAL STRUCTURE TO ENHANCE AUTOMATIC CHORD TRANSCRIPTION" in Proc. 10th International Society for Music Information Retrieval Conference (ISMIR 2009).

[9] M. Cooper and J. Foote. Summarizing popular music via structural similarity analysis. In WASPAA, New Platz, N.Y., USA, 2003.

[10] Paulus, J., Klapuri, A., "Music Structure Analysis Using a Probabilistic Fitness Measure And an Integrated Musicological Model", in Proc. of the 9th International Conference on Music Information Retrieval (ISMIR 2008), Philadelphia, Pa., USA, Sep. 14-18, 2008, pp. 369-374.

Available at http://www.cs.tut.fi/sgn/arg/paulus/paulus_ismir08.pdf.

[11] J. Foote, "Automatic Audio Segmentation using A measure of Audio Novelty" Proceedings of IEEE-ICME, vol. I, pp. 452-455, July 2000.

SUMMARY OF THE INVENTION

A first aspect of the invention provides an apparatus comprising: a beat tracking module for identifying beat time instants in an audio signal; a downbeat identifier for identifying downbeats occurring at beat time instants, each downbeat corresponding to the start of a musical bar or measure; and a pattern identifier for identifying two or more adjacent bars or measures containing musical characteristic which repeat within the audio signal, the pattern identifier being configured to: generate for each of a plurality of the downbeats a score using an analysis method for indicating a characteristic within the audio signal at the downbeat; and identify based on the score non-adjacent downbeats that correspond to the start of a musical pattern.

The pattern identifier may be further configured to generate a plurality of scores for each downbeat using respective analysis methods, each for indicating a different characteristic within the audio signal at the downbeat, to combine the scores for each downbeat, and wherein the step of identifying non-adjacent downbeats is based on the combined score.

The pattern identifier may configured to provide different sequences, e.g. S1, S2, of non-adjacent downbeats, e.g. S1=1, 3, 5, 7 and S2=2, 4, 8, 10, to identify based on the scores for each sequence the sequence that most likely corresponds to the start of a musical pattern, and to select the downbeats of that sequence. The pattern identifier may for example be configured to calculate the average or the product of the score or combined scores for the downbeats in each sequence, and to select the downbeats of the sequence which has the largest average or product.

The pattern identifier may generate the score, or at least one of the plurality of scores, using a classifier or function configured to indicate the likelihood that a beat corresponds to a pattern or non-pattern. The pattern identifier may for example use linear discriminate analysis (LDA) at or between beat time instants using templates trained to discriminate between beats at the start of a musical pattern and other beats.

The pattern identifier may generate the score, or at least one of the plurality of scores, by generating a chord change likelihood value from the audio signal and applying LDA to said value.

The pattern identifier may generate the score, or at least one of the plurality of scores, by extracting chroma accent features from the audio signal and applying LDA to said features.

The pattern identifier may generate the score, or at least one of the plurality of scores, by extracting chroma accent features using fundamental frequency (f0) salience analysis and another by extracting chroma accent features from each of a plurality of sub-bands of the audio signal.

The pattern identifier may generate the score, or at least one of the plurality of scores, by creating a self distance matrix (SDM) between chroma features extracted from the audio signal and correlating the SDM with a predetermined kernel to derive a novelty score indicative of structural changes for each downbeat.

The pattern identifier may generates the score, or at least one of the plurality of scores, by creating a SDM between chroma features extracted from the audio signal and identifying repetition regions therein which start at the location of a downbeat in the SDM, the score being derived based on the number of repetitions.

The pattern identifier may generate the score, or at least one of the plurality of scores, based on the number of repetitions for which the mean correlation value is equal to, or larger than, and predetermined number. The predetermined number may be substantially 0.8. In the event that more than a predetermined number of repetitions are identified, the score is derived based on a subset of repetitions having the largest average correlation values.

Overlapping repetition regions may be disregarded when deriving the score.

The pattern identifier may further perform median filtering of the SDM prior to identifying repetitions.

The pattern identifier may generate one score by using a first SDM based on Euclidean distance, and another score by using a second SDM based on the Pearson correlation coefficient or Cosine distance.

The pattern identifier may generate the score, or at least one of the plurality of scores, by: extracting chroma accent vectors from the signal; allocating the chroma feature vectors to one of a predetermined number of clusters; determining for each cluster whether or not an audio change is present based on parameters of the associated chroma accent vectors; allocating to each downbeat a score based on the number of chroma accent vectors, temporally local to the downbeat, having a determined audio change. The step of allocating the chroma feature vectors to one of a predetermined number of clusters may comprise: initially assigning the chroma feature vectors to one of an initial set of clusters based on a distance measure; splitting the cluster having the largest number of chroma feature vectors into two vectors; and repeating the splitting step until the predetermined number of clusters is reached.

The pattern identifier may be arranged to identify from the identified downbeats one or more fundamental downbeats representing the start of a musical section, e.g. verse, chorus, intro or outro.

The method may further comprise a video editing module for automatically editing video content using an associated audio track, the video editing module being configured to select one or more editing points for the video from the identified downbeats. For example, the video content may comprise images of a slideshow with the video editing module automatically creating editing points for visualisations or transitions. In another example, the video content is one or more video clips with editing points being used for transitions or effect in the video. The video editing module may be further configured to select the or each editing point based on a probability assigned to each identified downbeat.

The apparatus may further comprise: a receiver for receiving a plurality of video clips, each having a respective audio signal having common content; and a video editing module for identifying possible editing points for the video clips using the identified downbeats that correspond to the start of a musical pattern. The video editing module may further be configured to join a plurality of video clips at one or more of the identified editing points to generate a joined video clip.

The video editing module may be further configured to join the video clips at a selected subset of the identified editing points based on probabilities or weightings assigned to each identified downbeat.

A second aspect of the invention provides a method comprising: (a) identifying beat time instants in an audio signal; (b) identifying downbeats occurring at beat time instants, each downbeat corresponding to the start of a musical bar or measure; (c) identifying two or more adjacent bars or measures containing musical characteristics which repeat within the audio signal by (i) generating for each of a plurality of the downbeats a score using an analysis method for indicating a characteristic within the audio signal at the downbeat; and (ii) identifying based on the score non-adjacent downbeats that correspond to the start of a musical pattern.

Step (c)(i) may further comprise generating a plurality of scores for each downbeat using a respective analysis method for indicating different characteristics within the audio signal at the downbeat, and combining the scores for each downbeat, and wherein step (c)(ii) is based on the combined scores.

Step (c)(ii) may include providing different sequences, e.g. S1, S2, of non-adjacent downbeats, e.g. S1=1, 3, 5, 7 and S2=2, 4, 8, 10, to identify based on the scores for each sequence the sequence that most likely corresponds to the start of a musical pattern, and to select the downbeats of that sequence. The pattern identifier may be configured to calculate the average or the product of the score or combined scores for the downbeats in each sequence, and selecting the downbeats of the sequence which has the largest average or product.

Step (c)(i) may comprise generating the score, or at least one of the plurality of scores, using a classifier or function configured to indicate the likelihood that a beat corresponds to a pattern or non-pattern. The pattern identifier may use linear discriminate analysis (LDA) at or between beat time instants using templates trained to discriminate between beats at the start of a musical pattern and other beats.

Step (c)(i) may comprise generating a chord change likelihood value from the audio signal and applying LDA to said value.

Step (c)(i) may comprise extracting chroma accent features from the audio signal and applying LDA to said features.

Step (c)(i) may generates the score, or at least one of the plurality of scores, by extracting chroma accent features using fundamental frequency (f0) salience analysis and another by extracting chroma accent features from each of a plurality of sub-bands of the audio signal.

Step (c)(i) may generate the score, or at least one of the plurality of scores, by creating a self distance matrix (SDM) between chroma features extracted from the audio signal and correlating the SDM with a predetermined kernel to derive a novelty score indicative of structural changes for each downbeat.

Step (c)(i) may generate the score, or at least one of the plurality of scores, by creating a SDM between chroma features extracted from the audio signal and identifying repetition regions therein which start at the location of a downbeat in the SDM, the score being derived based on the number of repetitions.

Step (c)(i) may generate the score based on the number of repetitions for which the mean correlation value is equal to, or larger than, and predetermined number. The predetermined number may for example be substantially 0.8.

In the event that more than a predetermined number of repetitions are identified, the score may be derived based on a subset of repetitions having the largest average correlation values.

Overlapping repetition regions may be disregarded when deriving the score.

Step (c)(i) may further comprise median filtering the SDM prior to identifying repetitions.

Step (c)(i) may comprise generating one score using a first SDM based on Euclidean distance, and another score using a second SDM based on the Pearson correlation coefficient or Cosine distance.

Step c(i) may comprise generating the score, or at least one of the plurality of scores, by: extracting chroma accent vectors from the signal; allocating the chroma feature vectors to one of a predetermined number of clusters; determining for each cluster whether or not an audio change is present based on parameters of the associated chroma accent vectors; allocating to each downbeat a score based on the number of chroma accent vectors, temporally local to the downbeat, having a determined audio change.

The step of allocating the chroma feature vectors to one of a predetermined number of clusters may comprise: initially assigning the chroma feature vectors to one of an initial set of clusters based on a distance measure; splitting the cluster having the largest number of chroma feature vectors into two vectors; and repeating the splitting step until the predetermined number of clusters is reached.

The identifying step may involve identifying from the identified downbeats one or more fundamental downbeats representing the start of a musical section, e.g. verse, chorus, intro or outro.

The method may further comprise editing video content using an associated audio track by selecting one or more editing points for the video from the identified downbeats.

The or each editing point may be selected based on a probability assigned to each identified downbeat.

The method may comprise: receiving a plurality of video clips, each having a respective audio signal having common content; and identifying possible editing points for the video clips using the identified downbeats that correspond to the start of a musical pattern.

The method may further comprise joining a plurality of video clips at one or more of the identified editing points to generate a joined video clip.

The method may further comprise joining the video clips at a selected subset of the identified editing points based on probabilities or weighting assigned to each identified downbeat.

A third aspect of the invention provides a computer program comprising instructions that when executed by a computer apparatus control it to perform the steps of (a) identifying beat time instants in an audio signal; (b) identifying downbeats occurring at beat time instants, each downbeat corresponding to the start of a musical bar or measure; (c) identifying two or more adjacent bars or measures containing musical characteristics which repeat within the audio signal by (i) generating for each of a plurality of the downbeats a score using an analysis method for indicating a characteristic within the audio signal at the downbeat; and (ii) identifying based on the score non-adjacent downbeats that correspond to the start of a musical pattern.

A fourth aspect of the invention provides a non-transitory computer-readable storage medium having stored thereon computer-readable code, which, when executed by computing apparatus, causes the computing apparatus to perform a method comprising: (a) identifying beat time instants in an audio signal; (b) identifying downbeats occurring at beat time instants, each downbeat corresponding to the start of a musical bar or measure; (c) identifying two or more adjacent bars or measures containing musical characteristics which repeat within the audio signal by (i) generating for each of a plurality of the downbeats a score using an analysis method for indicating a characteristic within the audio signal at the downbeat; and (ii) identifying based on the score non-adjacent downbeats that correspond to the start of a musical pattern.

A fifth aspect provides an apparatus, the apparatus having at least one processor and at least one memory having computer-readable code stored thereon which when executed controls the at least one processor: (a) to identify beat time instants in an audio signal; (b) to identify downbeats occurring at beat time instants, each downbeat corresponding to the start of a musical bar or measure; (c) to identify two or more adjacent bars or measures containing musical characteristics which repeat within the audio signal by (i) generating for each of a plurality of the downbeats a score using an analysis method for indicating a characteristic within the audio signal at the downbeat; and (ii) identifying based on the score non-adjacent downbeats that correspond to the start of a musical pattern.

Step (c)(i) may further comprise generating a plurality of scores for each downbeat using a respective analysis method for indicating different characteristics within the audio signal at the downbeat, and combining the scores for each downbeat, and wherein step (c)(ii) is based on the combined scores.

Step (c)(ii) may include providing different sequences, e.g. S1, S2, of non-adjacent downbeats, e.g. S1=1, 3, 5, 7 and S2=2, 4, 8, 10, to identify based on the scores for each sequence the sequence that most likely corresponds to the start of a musical pattern, and to select the downbeats of that sequence. The pattern identifier may be configured to calculate the average or the product of the score or combined scores for the downbeats in each sequence, and selecting the downbeats of the sequence which has the largest average or product.

Step (c)(i) may comprise generating the score, or at least one of the plurality of scores, using a classifier or function configured to indicate the likelihood that a beat corresponds to a pattern or non-pattern. The pattern identifier may use linear discriminate analysis (LDA) at or between beat time instants using templates trained to discriminate between beats at the start of a musical pattern and other beats.

Step (c)(i) may comprise generating a chord change likelihood value from the audio signal and applying LDA to said value.

Step (c)(i) may comprise extracting chroma accent features from the audio signal and applying LDA to said features.

Step (c)(i) may generates the score, or at least one of the plurality of scores, by extracting chroma accent features using fundamental frequency (f0) salience analysis and another by extracting chroma accent features from each of a plurality of sub-bands of the audio signal.

Step (c)(i) may generate the score, or at least one of the plurality of scores, by creating a self distance matrix (SDM) between chroma features extracted from the audio signal and correlating the SDM with a predetermined kernel to derive a novelty score indicative of structural changes for each downbeat.

Step (c)(i) may generate the score, or at least one of the plurality of scores, by creating a SDM between chroma features extracted from the audio signal and identifying repetition regions therein which start at the location of a downbeat in the SDM, the score being derived based on the number of repetitions.

Step (c)(i) may generate the score based on the number of repetitions for which the mean correlation value is equal to, or larger than, and predetermined number. The predetermined number may for example be substantially 0.8.

In the event that more than a predetermined number of repetitions are identified, the score may be derived based on a subset of repetitions having the largest average correlation values.

Overlapping repetition regions may be disregarded when deriving the score.

Step (c)(i) may further comprise median filtering the SDM prior to identifying repetitions.

Step (c)(i) may comprise generating one score using a first SDM based on Euclidean distance, and another score using a second SDM based on the Pearson correlation coefficient or Cosine distance.

Step c(i) may comprise generating the score, or at least one of the plurality of scores, by: extracting chroma accent vectors from the signal; allocating the chroma feature vectors to one of a predetermined number of clusters; determining for each cluster whether or not an audio change is present based on parameters of the associated chroma accent vectors; allocating to each downbeat a score based on the number of chroma accent vectors, temporally local to the downbeat, having a determined audio change.

The step of allocating the chroma feature vectors to one of a predetermined number of clusters may comprise: initially assigning the chroma feature vectors to one of an initial set of clusters based on a distance measure; splitting the cluster having the largest number of chroma feature vectors into two vectors; and repeating the splitting step until the predetermined number of clusters is reached.

Pattern identification may involve identifying from the identified downbeats one or more fundamental downbeats representing the start of a musical section, e.g. verse, chorus, intro or outro.

The steps may further comprise editing video content using an associated audio track by selecting one or more editing points for the video from the identified downbeats.

The or each editing point may be selected based on a probability assigned to each identified downbeat.

The steps may further comprise: receiving a plurality of video clips, each having a respective audio signal having common content; and identifying possible editing points for the video clips using the identified downbeats that correspond to the start of a musical pattern.

The steps may further comprise joining a plurality of video clips at one or more of the identified editing points to generate a joined video clip.

The steps may further comprise joining the video clips at a selected subset of the identified editing points based on probabilities or weighting assigned to each identified downbeat.

BRIEF DESCRIPTION OF THE DRAWINGS

Embodiments of the invention will now be described by way of non-limiting example with reference to the accompanying drawings, in which.

DETAILED DESCRIPTION OF EMBODIMENTS

Embodiments described below relate to systems and methods for audio analysis, primarily the analysis of music and its musical meter and structure or form in order to identify musical patterns. In general this can be done in practise first by performing beat tracking using any known method, although in this specification we describe in detail a method already described in Applicant's co-pending patent application number PCT/IB2012/053329 the contents of which are incorporated herein by reference. Downbeats are then identified, for instance in the manner described in Applicant's co-pending patent application number PCT/IB2012/052157 the contents of which are incorporated herein by reference. Signal analysis is then performed to generate a pattern score for the signal, and based on this score at the location of the detected downbeats, a determination is made as to which downbeats represent the start of a musical pattern. The score is in fact a summation of multiple pattern scores each of which results from a respective analysis method, to be described below.

As noted above, a downbeat occurring at the start of a musical pattern is considered to represent a musically meaningful point that can be used for various practical applications, including music recommendation algorithms, DJ applications and automatic looping. The specific embodiments described below relate to a video editing system which automatically cuts video clips using downbeats at the start of musical patterns.

Figure 1:
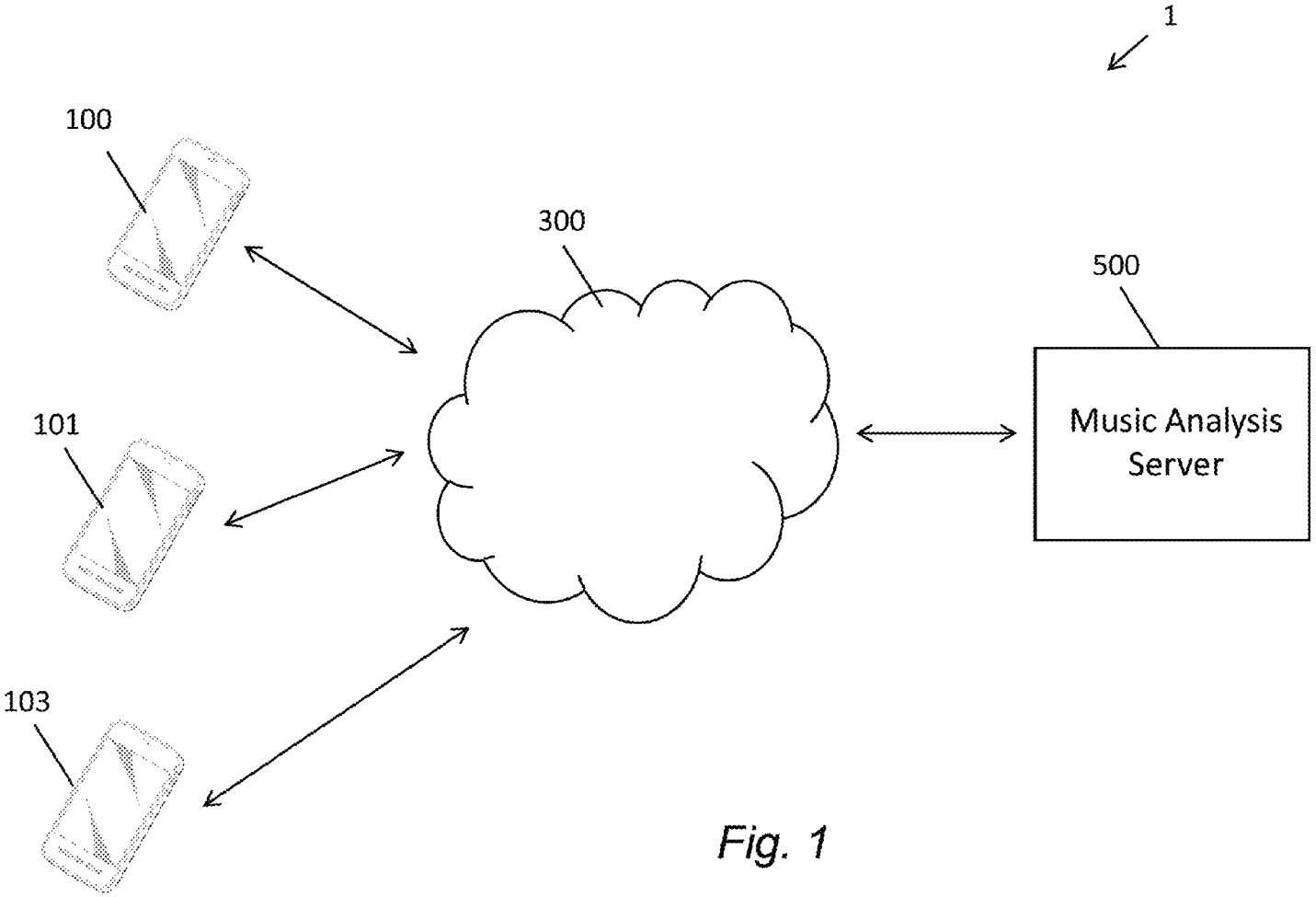
FIG. 1 is a schematic diagram of a network including a music analysis server according to embodiments of the invention and a plurality of terminals.

Referring to FIG. 1, a music analysis server 500 (hereafter "analysis server") is shown connected to a network 300, which can be any data network such as a Local Area Network (LAN), Wide Area Network (WAN) or the Internet. The analysis server 500 is configured to analyse audio associated with received video clips in order to identify downbeats corresponding to the start of musical patterns for the purpose of automated video editing. This will be described in detail later on.

One or more external terminals 100, 101, 103 in use communicate with the analysis server 500 via the network 300, in order to upload video clips having an associated audio track. In the present case, three terminals 100, 101, 103 are shown, each incorporating video camera and audio capture (i.e. microphone) hardware and software for the capturing, storing and uploading and downloading of video data over the network 300. The analysis server 500 may however receive video and/or audio tracks from just one external terminal 100.

Figure 2:
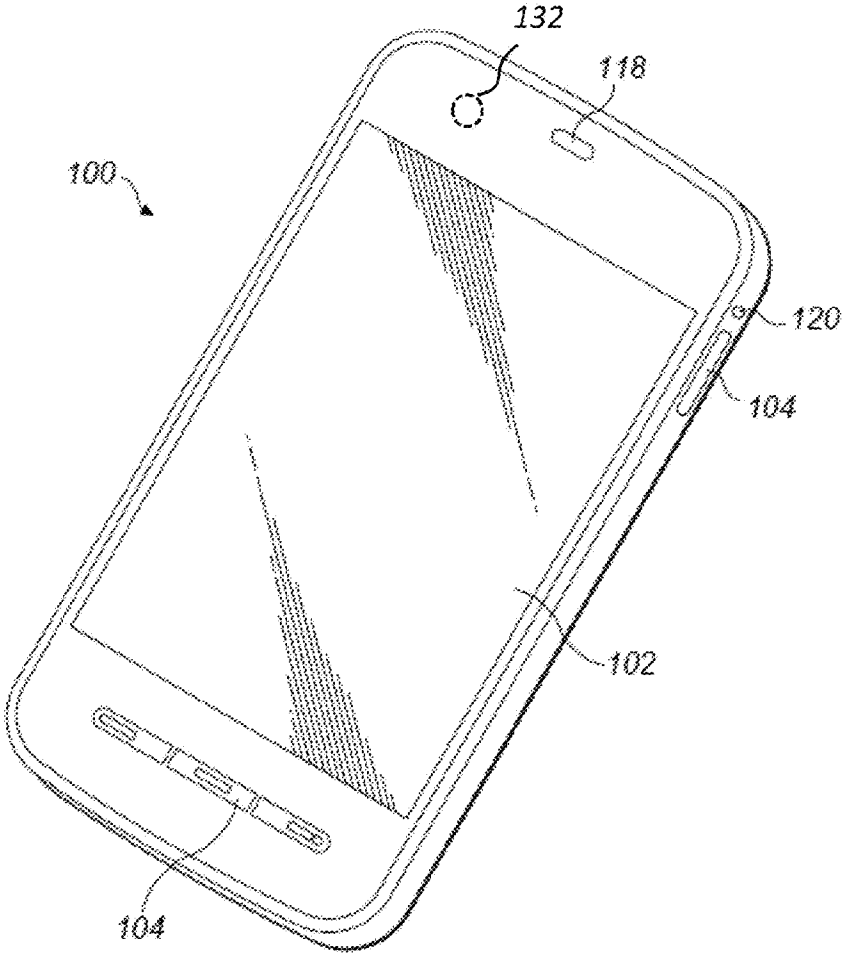
FIG. 2 is a perspective view of one of the terminals shown in FIG. 1.

Referring to FIG. 2, one of said terminals 100 is shown, although the other terminals 101, 103 are considered identical or similar. The exterior of the terminal 100 has a touch sensitive display 102, hardware keys 104, a rear-facing camera 105, a speaker 118 and a headphone port 120.

Figure 3:
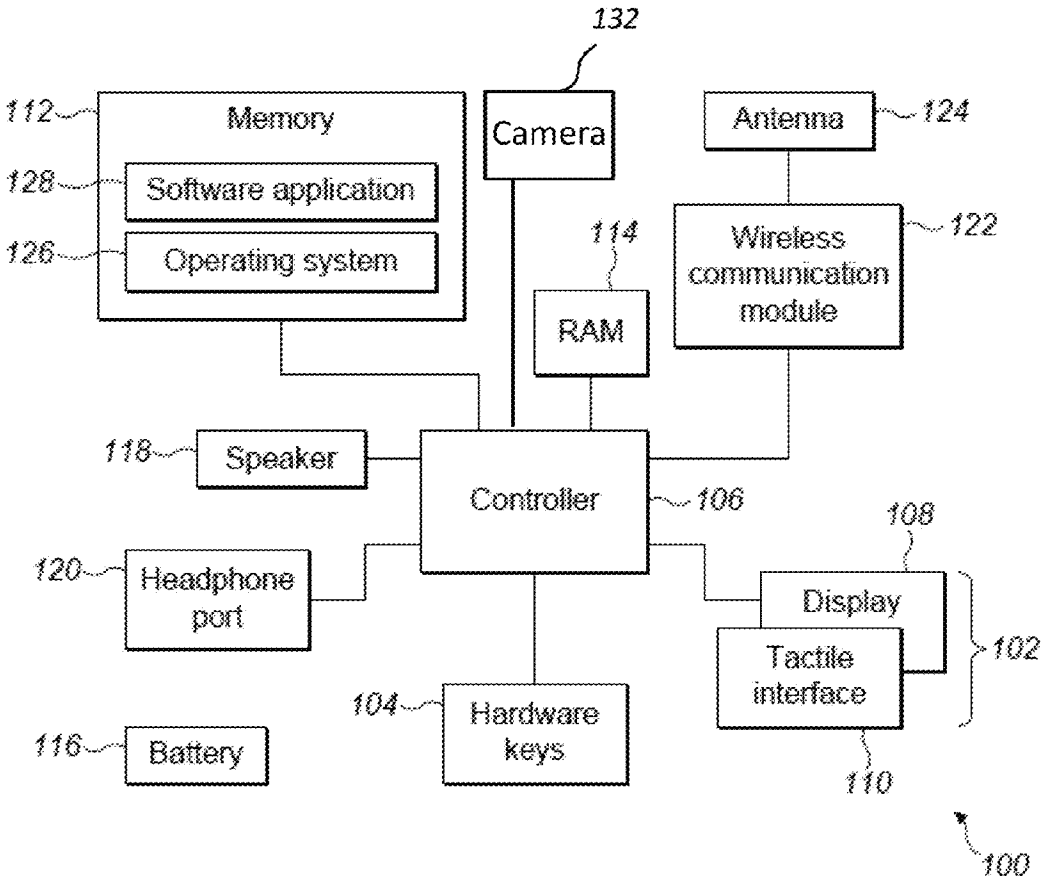
FIG. 3 is a schematic diagram of components of the terminal shown in FIG. 2.

FIG. 3 shows a schematic diagram of the components of terminal 100. The terminal 100 has a controller 106, a touch sensitive display 102 comprised of a display part 108 and a tactile interface part 110, the hardware keys 104, the camera 132, a memory 112, RAM 114, a speaker 118, the headphone port 120, a wireless communication module 122, an antenna 124 and a battery 116. The controller 106 is connected to each of the other components (except the battery 116) in order to control operation thereof.

The memory 112 may be a non-volatile memory such as read only memory (ROM) a hard disk drive (HDD) or a solid state drive (SSD). The memory 112 stores, amongst other things, an operating system 126 and may store software applications 128. The RAM 114 is used by the controller 106 for the temporary storage of data. The operating system 126 may contain code which, when executed by the controller 106 in conjunction with RAM 114, controls operation of each of the hardware components of the terminal.

The controller 106 may take any suitable form. For instance, it may be a microcontroller, plural microcontrollers, a processor, or plural processors.

The terminal 100 may be a mobile telephone or smartphone, a personal digital assistant (PDA), a portable media player (PMP), a portable computer or any other device capable of running software applications and providing audio outputs. In some embodiments, the terminal 100 may engage in cellular communications using the wireless communications module 122 and the antenna 124. The wireless communications module 122 may be configured to communicate via several protocols such as Global System for Mobile Communications (GSM), Code Division Multiple Access (CDMA), Universal Mobile Telecommunications System (UMTS), Bluetooth and IEEE 802.11 (Wi-Fi).

The display part 108 of the touch sensitive display 102 is for displaying images and text to users of the terminal and the tactile interface part 110 is for receiving touch inputs from users.

As well as storing the operating system 126 and software applications 128, the memory 112 may also store multimedia files such as music and video files. A wide variety of software applications 128 may be installed on the terminal including Web browsers, radio and music players, games and utility applications. Some or all of the software applications stored on the terminal may provide audio outputs. The audio provided by the applications may be converted into sound by the speaker(s) 118 of the terminal or, if headphones or speakers have been connected to the headphone port 120, by the headphones or speakers connected to the headphone port 120.

In some embodiments the terminal 100 may also be associated with external software application not stored on the terminal. These may be applications stored on a remote server device and may run partly or exclusively on the remote server device. These applications can be termed cloud-hosted applications. The terminal 100 may be in communication with the remote server device in order to utilise the software application stored there. This may include receiving audio outputs provided by the external software application.

In some embodiments, the hardware keys 104 are dedicated volume control keys or switches. The hardware keys may for example comprise two adjacent keys, a single rocker switch or a rotary dial. In some embodiments, the hardware keys 104 are located on the side of the terminal 100.

One of said software applications 128 stored on memory 112 is a dedicated application (or "App") configured to upload captured video clips, including their associated audio track, to the analysis server 500.

The analysis server 500 is configured to receive video clips from the terminals 100, 101, 103, to identify downbeats in each associated audio track, and then the downbeats which correspond to the start of identified musical patterns, e.g. for the purpose of automatic video processing and editing, for example to join clips together at musically meaningful points and/or to generate music visualisations, e.g. the timing of transitions between static images in a slideshow. Instead of identifying music patterns in each associated audio track, the analysis server 500 may additionally or alternatively be configured to identify patterns in a single audio track, e.g. received from just one terminal 100, or a common audio track which has been obtained by combining parts from the audio track of one or more video clips.

Figure 4A:
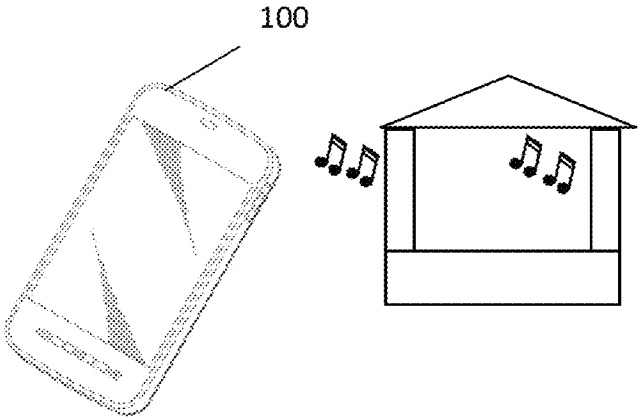
FIGS. 4(*a*) and (*b*) are a schematic diagrams showing the terminal(s) of FIG. 1 in use examples.
Figure 4B:
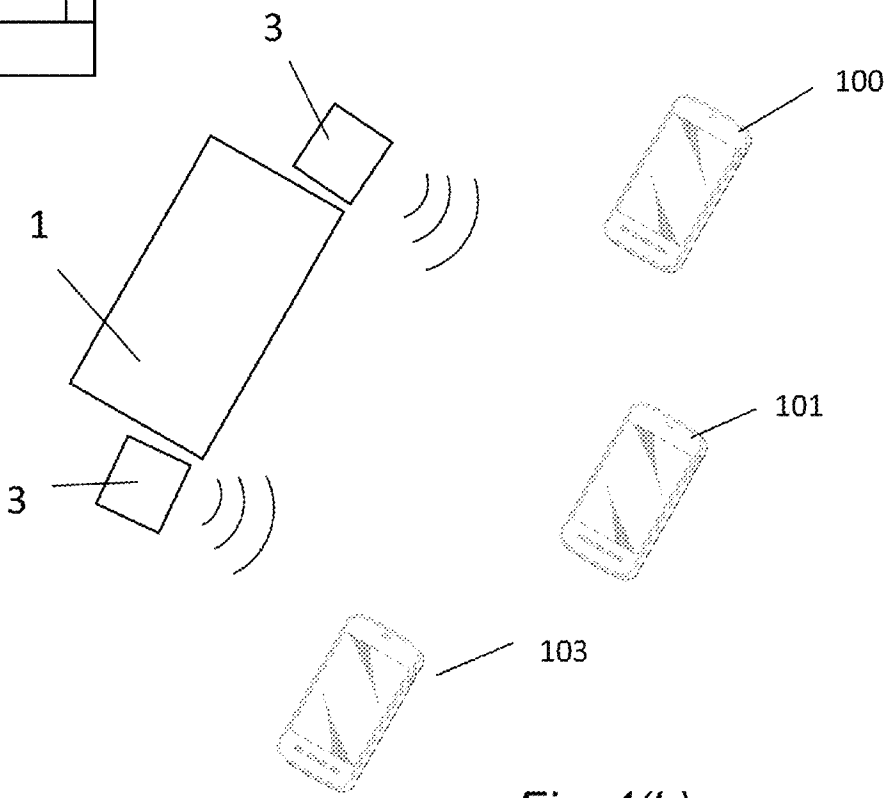

Referring to FIGS. 4(*a*) and 4(*b*), practical examples will now be described. FIG. 4(*a*) shows a terminal 100 being used to capture a concert, both in terms of video and audio. The user of the terminal 100 subsequently uploads their video clip to the analysis server 500, either using their above-mentioned App or from a computer with which the terminal synchronises. The user may be prompted to identify the event, either by entering a description of the event, or by selecting an already-registered event from a pull-down menu. Alternative identification methods may be envisaged, for example by using associated GPS data from the terminals 100, 101, 103 to identify the capture location. At the analysis server 500, subsequent analysis of the video clip, or even plural video clips received from the single terminal 100, can then be performed to identify musical patterns which are used for some automated purpose, e.g. visualisations or as video editing points. The analysis server 500 may in some embodiments be provided within the terminal 100, i.e. the terminal 100 may perform the processing attributed below to the analysis server 500.

Referring to FIG. 4(*b*), in a different scenario, each of the terminals 100, 101, 103 is shown in use at an event which is a music concert represented by a stage area 1 and speakers 3. Each terminal 100, 101, 103 is assumed to be capturing the event using their respective video cameras; given the different positions of the terminals 100, 101, 103 the respective video clips will be different but there will be a common audio track providing they are all capturing over a common time period.

Users of the terminals 100, 101, 103 subsequently upload their video clips to the analysis server 500, either using their above-mentioned App or from a computer with which the terminal synchronises. At the same time, users are prompted to identify the event, either by entering a description of the event, or by selecting an already-registered event from a pull-down menu. Alternative identification methods may be envisaged, for example by using associated GPS data from the terminals 100, 101, 103 to identify the capture location.

At the analysis server 500, received video clips from the terminals 100, 101, 103 are identified as being associated with a common event. Subsequent analysis of each video clip can then be performed to identify musical patterns which are used for some automated purpose, such as for visualisations or for indicating useful video angle switching points for automated video editing.

Figure 5:
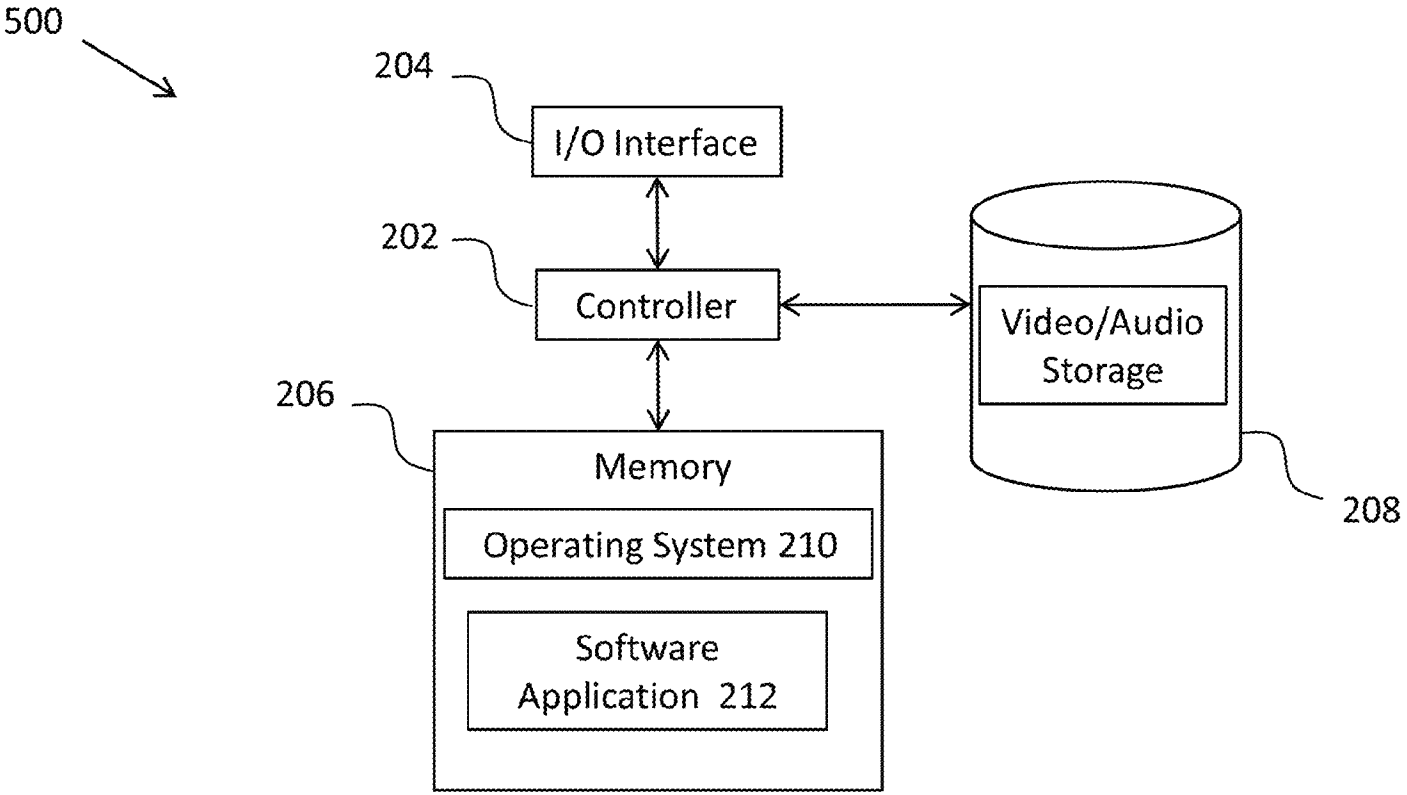
FIG. 5 is a schematic diagram of components of the analysis server shown in FIG. 1.

Referring to FIG. 5, hardware components of the analysis server 500 are shown. These include a controller 202, an input and output interface 204, a memory 206 and a mass storage device 208 for storing received video and audio clips. The controller 202 is connected to each of the other components in order to control operation thereof.

The memory 206 (and mass storage device 208) may be a non-volatile memory such as read only memory (ROM) a hard disk drive (HDD) or a solid state drive (SSD). The memory 206 stores, amongst other things, an operating system 210 and may store software applications 212. RAM (not shown) is used by the controller 202 for the temporary storage of data. The operating system 210 may contain code which, when executed by the controller 202 in conjunction with RAM, controls operation of each of the hardware components.

The controller 202 may take any suitable form. For instance, it may be a microcontroller, plural microcontrollers, a processor, or plural processors.

The software application 212 is configured to control and perform the video processing, including processing the associated audio signal to identify musical patterns. The operation of the software application 212 will now be described in detail.

Figure 6:
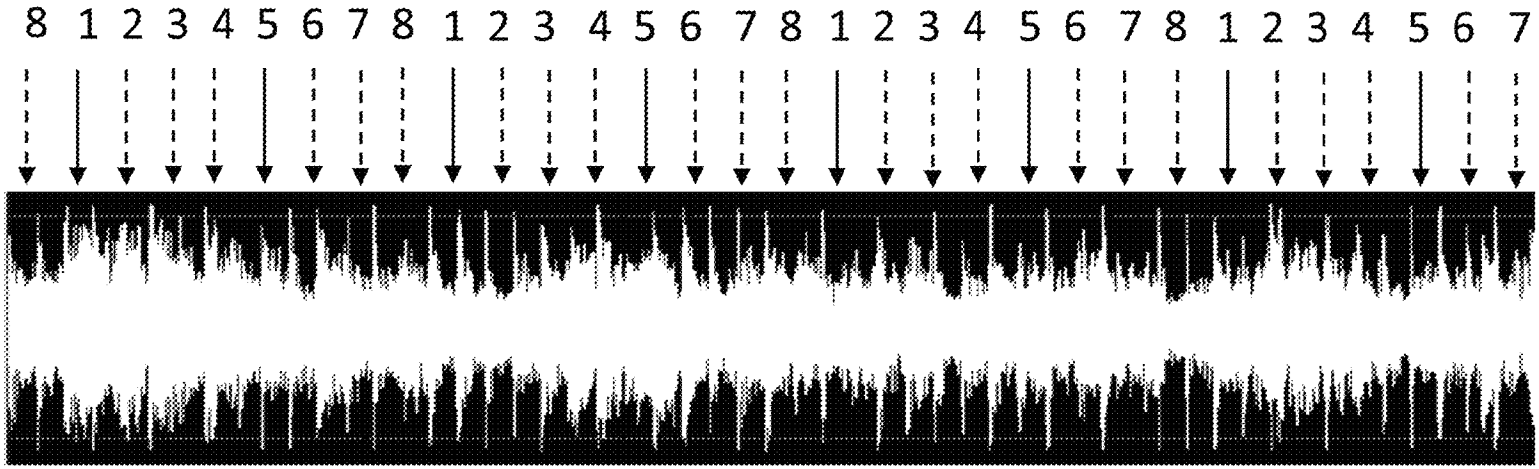
FIG. 6 is a schematic diagram of an audio signal with beats and downbeats shown, which is useful for understanding the invention.

FIG. 6 depicts an example musical signal with beats and downbeats indicated by arrows. A beat is shown with a broken arrow and a downbeat with a solid arrow. In this particular example, each measure comprises four beats. The numbering indicates the counting of beats from one to eight during a two measure pattern, which we assume is the pattern that the software application 212 is configured to detect in this example. The pattern may begin at structural boundaries of the music piece, e.g. beginnings of musical sections such as the introduction, verse, chorus, bridge, outro and so on. Therefore, the method also uses elements of existing algorithms used for the structural analysis of songs to provide signals that provide an indication of whether certain beats correspond to structural boundaries.

Figure 7:
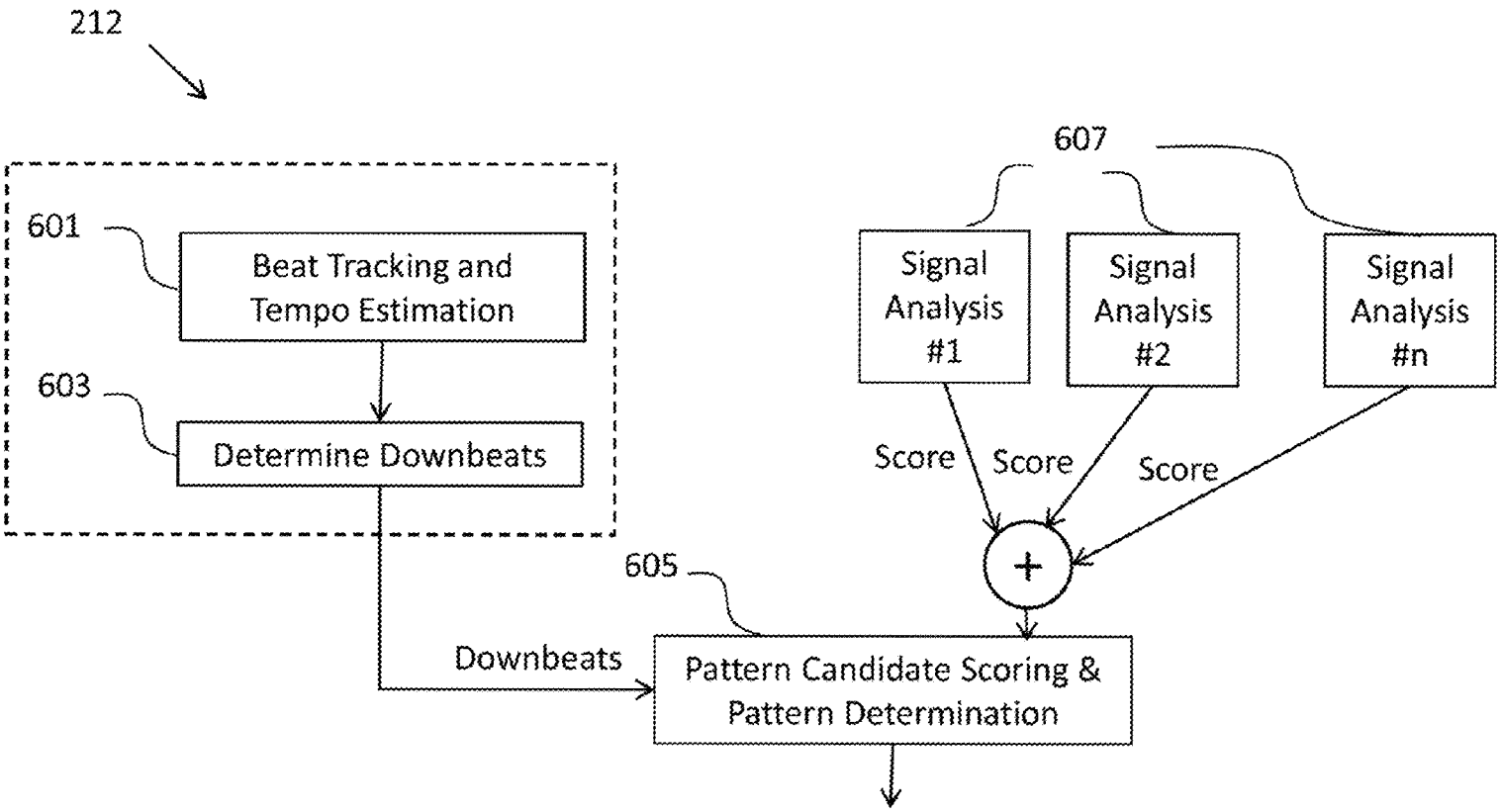
FIG. 7 is a block diagram showing processing stages performed by the analysis server shown in FIG. 1.

FIG. 7 shows in overview functional modules of the software application 212. A beat tracking and tempo estimation module 601 obtains the BPM and beat locations for the input signal, i.e. the arrows shown in FIG. 6. A downbeat determining module 603 then identifies which of the beats are the downbeats, i.e. the solid arrows in FIG. 6. These two modules 601, 603 can use any known beat tracking and downbeat determination method, but later on we describe some example methods. A number of signal analysis modules 607 are used to perform respective different analysis methods on the signal, primarily to identify regions which repeat in the music and/or structural boundaries. Each such method generates a score which is normalised and the normalised scores summed A pattern candidate scoring and pattern determination module 605 takes the scores at the position of the downbeats and makes a decision as to which of the downbeats correspond to the start of a musical pattern. In an enhancement, the module 605 also determines which downbeats correspond to the start of a structural boundary.

Implementation details of each module will now be described.

Beat Tracking and Tempo Estimation 601

A suitable method is that which is described in Applicant's co-pending patent application number PCT/IB2012/053329 which for completeness is described here with reference to FIGS. 8 to 14.

Figure 8:
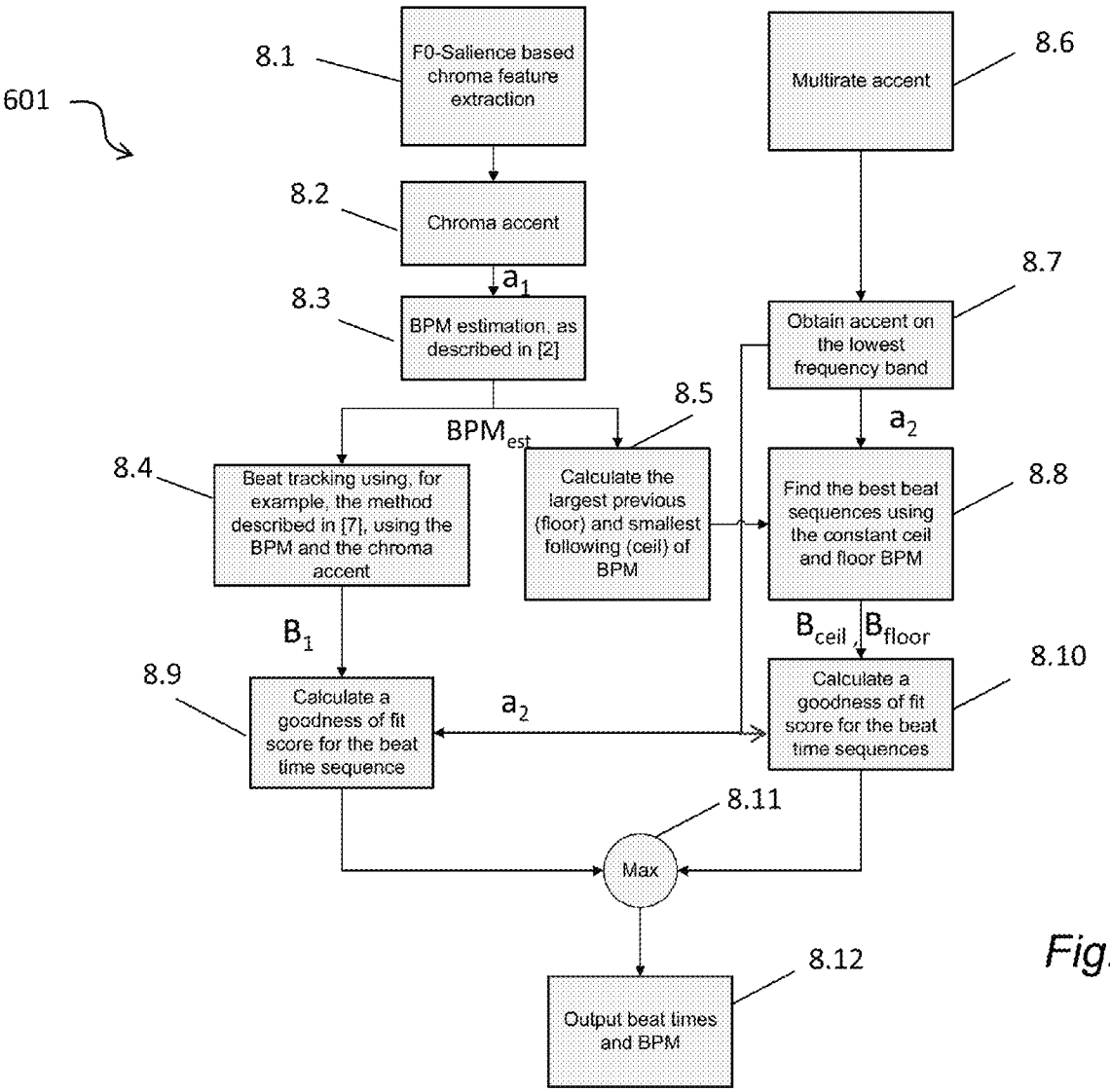
FIG. 8 is a block diagram showing processing stages performed by a beat tracking and tempo estimating sub-stage shown in FIG. 7.

Referring to FIG. 8, it will be seen that there are, conceptually at least, two processing paths, starting from steps 8.1 and 8.6. The reference numerals applied to each processing stage are not indicative of order of processing. In some implementations, the processing paths might be performed in parallel allowing fast execution. In overview, three beat time sequences are generated from an inputted audio signal, specifically from accent signals derived from the audio signal. A selection stage then identifies which of the three beat time sequences is a best match or fit to one of the accent signals, this sequence being considered the most useful and accurate for the video processing application or indeed any application with which beat tracking may be useful.

Each processing stage will now be considered in turn.

First (Chroma) Accent Signal Stage

The method starts in steps 8.1 and 8.2 by calculating a first accent signal ($a_1$) based on fundamental frequency ($F_0$) salience estimation. This accent signal ($a_1$), which is a chroma accent signal, is extracted as described in [2]. The chroma accent signal ($a_1$) represents musical change as a function of time and, because it is extracted based on the $F_0$ information, it emphasizes harmonic and pitch information in the signal. Note that, instead of calculating a chroma accent signal based on $F_0$ salience estimation, alternative accent signal representations and calculation methods could be used. For example, the accent signals described in [5] or [7] could be utilized.

Figure 11:
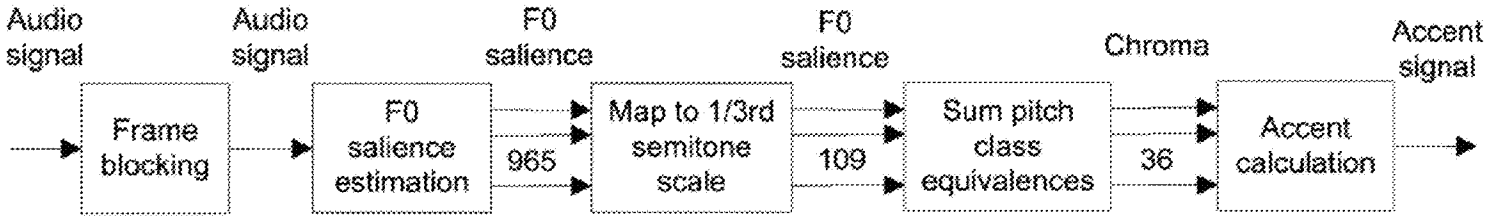

FIG. 11 depicts an overview of the first accent signal calculation method. The first accent signal calculation method uses chroma features. There are various ways to extract chroma features, including, for example, a straightforward summing of Fast Fourier Transform bin magnitudes to their corresponding pitch classes or using a constant-Q transform. In our method, we use a multiple fundamental frequency ($F_0$) estimator to calculate the chroma features. The $F_0$ estimation can be done, for example, as proposed in [8]. The input to the method may be sampled at a 44.1-kHz sampling rate and have a 16-bit resolution. Framing may be applied on the input signal by dividing it into frames with a certain amount of overlap. In our implementation, we have used 93-ms frames having 50% overlap. The method first spectrally whitens the signal frame, and then estimates the strength or salience of each $F_0$ candidate. The $F_0$ candidate strength is calculated as a weighted sum of the amplitudes of its harmonic partials. The range of fundamental frequencies used for the estimation is 80-640 Hz. The output of the $F_0$ estimation step is, for each frame, a vector of strengths of fundamental frequency candidates. Here, the fundamental frequencies are represented on a linear frequency scale. To better suit music signal analysis, the fundamental frequency saliences are transformed on a musical frequency scale. In particular, we use a frequency scale having a resolution of $\frac{1}{3}^{rd}$-semitones, which corresponds to having 36 bins per octave. For each ⅓rd of a semitone range, the system finds the fundamental frequency component with the maximum salience value and retains only that. To obtain a 36-dimensional chroma vector $x_b(k)$, where k is the frame index and $b=1, 2, \ldots, b_0$ is the pitch class index, with $b_0=36$, the octave equivalence classes are summed over the whole pitch range. A normalized matrix of chroma vectors $\hat{x}_b(k)$ is obtained by subtracting the mean and dividing by the standard deviation of each chroma coefficient over the frames k.

The following step is estimation of musical accent using the normalized chroma matrix $\hat{x}_b(k)$, $k=1, \ldots, K$ and $b=1, 2, \ldots, b_0$. The accent estimation resembles the method proposed in [5], but instead of frequency bands we use pitch classes here. To improve the time resolution, the time trajectories of chroma coefficients may be first interpolated by an integer factor. We have used interpolation by the factor eight. A straightforward method of interpolation by adding zeros between samples may be used. With our parameters, after the interpolation, the resulting sampling rate $f_x=172$ Hz. This is followed by a smoothing step, which is done by applying a sixth-order Butterworth low-pass filter (LPF). The LPF has a cuttoff frequency of $f_{LP}=10$ Hz. We denote the signal after smoothing with $z_b(n)$. The following step comprises differential calculation and half-wave rectification (HWR):

$$\dot{z}_b(n)=\mathrm{HWR}(z_b(n)-z_b(n-1)) \tag{1}$$

with HWR(x)=max(x,0). In the next step, a weighted average of $z_b(n)$ and its half-wave rectified differential $\dot{z}_b(n)$ is formed. The resulting signal is $$u_b(n) = (1-\rho)z_b(n) + \rho\frac{f_T}{f_{LP}}\dot{z}_b(n). \tag{2}$$

In Equation (2), the factor $0\leq\rho\leq1$ controls the balance between $z_b(n)$ and its half-wave rectified differential. In our implementation, the value of $\rho=0.6$. In one embodiment of the invention, we obtain an accent signal $a_1$ based on the above accent signal analysis by linearly averaging the bands b. Such an accent signal represents the amount of musical emphasis or accentuation over time.

First Beat Tracking Stage

In step 8.3, an estimation of the audio signal's tempo (hereafter "$BPM_{est}$") is made using the method described in [2].

The first step in the tempo estimation is periodicity analysis. The periodicity analysis is performed on the accent signal ($a_1$). The generalized autocorrelation function (GACF) is used for periodicity estimation. To obtain periodicity estimates at different temporal locations of the signal, the GACF is calculated in successive frames. The length of the frames is W and there is 16% overlap between adjacent frames. No windowing is used. At the $m^{th}$ frame, the input vector for the GACF is denoted $a_m$:

$$a_m=[a_1((m-1)W), \ldots, a_1(mW-1), 0, \ldots, 0]^T \tag{3}$$

where T denotes transpose. The input vector is zero padded to twice its length, thus, its length is 2 W. The GACF may be defined as $$\gamma_m(\tau)=\mathrm{IDFT}(|\mathrm{DFT}(a_m)|^p) \tag{4}$$

where discrete Fourier transform and its inverse are denoted by DFT and IDFT, respectively. The amount of frequency domain compression is controlled using the coefficient p. The strength of periodicity at period (lag) $\tau$ is given by $\gamma_m(\tau)$.

Other alternative periodicity estimators to the GACF include, for example, inter onset interval histogramming, autocorrelation function (ACF), or comb filter banks. Note that the conventional ACF can be obtained by setting p=2 in Equation (4). The parameter p may need to be optimized for different accent features. This may be done, for example, by experimenting with different values of p and evaluating the accuracy of periodicity estimation. The accuracy evaluation can be done, for example, by evaluating the tempo estimation accuracy on a subset of tempo annotated data. The value which leads to best accuracy may be selected to be used. For the chroma accent features used here, we can use, for example, the value p=0.65, which was found to perform well in this kind of experiments for the used accent features.

After periodicity estimation, there exists a sequence of periodicity vectors from adjacent frames. To obtain a single representative tempo for a musical piece or a segment of music, a point-wise median of the periodicity vectors over time may be calculated. The median periodicity vector may be denoted by $\gamma_{med}(\tau)$. Furthermore, the median periodicity vector may be normalized to remove a trend $$\hat{\gamma}_{med}(\tau) = \frac{1}{W_\tau}\gamma_{med}(\tau). \tag{5}$$

The trend is caused by the shrinking window for larger lags. A subrange of the periodicity vector may be selected as the final periodicity vector. The subrange may be taken as the range of bins corresponding to periods from 0.06 to 2.2 s, for example. Furthermore, the final periodicity vector may be normalized by removing the scalar mean and normalizing the scalar standard deviation to unity for each periodicity vector. The periodicity vector after normalization is denoted by $s(\tau)$. Note that instead of taking a median periodicity vector over time, the periodicity vectors in frames could be outputted and subjected to tempo estimation separately.

Tempo estimation is then performed based on the periodicity vector $s(\tau)$. The tempo estimation is done using k-Nearest Neighbour regression. Other tempo estimation methods could be used as well, such as methods based on finding the maximum periodicity value, possibly weighted by the prior distribution of various tempi.

Let's denote the unknown tempo of this periodicity vector with T. The tempo estimation may start with generation of resampled test vectors $s_r(\tau)$. r denotes the resampling ratio. The resampling operation may be used to stretch or shrink the test vectors, which has in some cases been found to improve results. Since tempo values are continuous, such resampling may increase the likelihood of a similarly shaped periodicity vector being found from the training data. A test vector resampled using the ratio r will correspond to a tempo of T/r. A suitable set of ratios may be, for example, 57 linearly spaced ratios between 0.87 and 1.15. The resampled test vectors correspond to a range of tempi from 104 to 138 BPM for a musical excerpt having a tempo of 120 BPM.

The tempo estimation comprises calculating the Euclidean distance between each training vector $t_m(\tau)$ and the resampled test vectors $s_r(\tau)$:

$$d(m, r) = \sqrt{\sum_\tau (t_m(\tau) - s_r(\tau))^2}\,. \tag{6}$$

In Equation (6), m=1, . . . , M is the index of the training vector. For each training instance m, the minimum distance $d(m)=\min_r d(m,r)$ may be stored. Also the resampling ratio that leads to the minimum distance $\dot{r}(m)=\text{argmin},d(m,r)$ is stored. The tempo may then be estimated based on the k nearest neighbors that lead to the k lowest values of d(m). The reference or annotated tempo corresponding to the nearest neighbor i is denoted by $T_{ann}(i)$. An estimate of the test vector tempo is obtained as $\hat{T}(i)=T_{ann}(i)\hat{r}(i)$.

The tempo estimate can be obtained as the average or median of the nearest neighbor tempo estimates $\hat{T}(i)$, i=1, . . . , k. Furthermore, weighting may be used in the median calculation to give more weight to those training instances that are closest to the test vector. For example, weights $w_i$ can be calculated as $$w_i = \frac{\exp(-\vartheta d(i))}{\sum_{i=1}^{k}\exp(-\vartheta d(i))}, \tag{7}$$

where i=1, . . . , k. The parameter θ may be used to control the steepness of the weighting. For example, the value θ=0.01 can be used. The tempo estimate $BPM_{est}$ can then be calculated as a weighted median of the tempo estimates $\hat{T}(i)$, i=1, . . . , k, using the weights $w_i$.

Referring still to FIG. 8, in step 8.4, beat tracking is performed based on the $BPM_{est}$ obtained in step 8.3 and the chroma accent signal ($a_1$) obtained in step 8.2. The result of this first beat tracking stage 8.4 is a first beat time sequence ($b_1$) indicative of beat time instants. For this purpose, we use a dynamic programming routine similar to the one described in [7]. This dynamic programming routine identifies the first sequence of beat times ($b_1$) which matches the peaks in the first chroma accent signal ($a_1$) allowing the beat period to vary between successive beats. There are alternative ways of obtaining the beat times based on a BPM estimate, for example, hidden Markov models, Kalman filters, or various heuristic approaches could be used. The benefit of the dynamic programming routine is that it effectively searches all possible beat sequences.

For example, the beat tracking stage 8.4 takes $BPM_{est}$ and attempts to find a sequence of beat times so that many beat times correspond to large values in the first accent signal ($a_1$). As suggested in [7], the accent signal is first smoothed with a Gaussian window. The half-width of the Gaussian window may be set to be equal to ⅓2 of the beat period corresponding to $BPM_{est}$.

After the smoothing, the dynamic programming routine proceeds forward in time through the smoothed accent signal values (a1). Let's denote the time index n. For each index n, it finds the best predecessor beat candidate. The best predecessor beat is found inside a window in the past by maximizing the product of a transition score and a cumulative score. That is, the algorithm calculates $\delta(n)=\max_l(ts(l)\cdot cs(n+l))$, here ts(l) is the transition score and cs(n+l) the cumulative score. The search window spans from l=−round(−2P), . . . , −round(P/2), where P is the period in samples corresponding to $BPM_{est}$. The transition score may be defined as $$ts(l) = \exp\left(-0.5\left(\theta * \log\left(\frac{l}{-P}\right)\right)^2\right), \tag{9}$$

where l=−round(−2P), . . . , −round(P/2) and the parameter θ=8 controls how steeply the transition score decreases as the previous beat location deviates from the beat period P. The cumulative score is stored as $cs(n)=\alpha\delta(n)+(1-\alpha)\alpha_1(n)$. The parameter α is used to keep a balance between past scores and a local match. The value α=0.8. The algorithm also stores the index of the best predecessor beat as $b(n)=n+\hat{l}$, where $\hat{l}=\text{argmax}_l(ts(l)\cdot cs(n+l))$.

In the end of the musical excerpt, the best cumulative score within one beat period from the end is chosen, and then the entire beat sequence $B_1$ which caused the score is traced back using the stored predecessor beat indices. The best cumulative score can be chosen as the maximum value of the local maxima of the cumulative score values within one beat period from the end. If such a score is not found, then the best cumulative score is chosen as the latest local maxima exceeding a threshold. The threshold here is 0.5 times the median cumulative score value of the local maxima in the cumulative score.

It is noted that the beat sequence obtained in step 8.4 can be used to update the $BPM_{est}$. In some embodiments of the invention, the $BPM_{est}$ is updated based on the median beat period calculated based on the beat times obtained from the dynamic programming beat tracking step.

The value of $BPM_{est}$ generated in step 8.3 is a continuous real value between a minimum BPM and a maximum BPM, where the minimum BPM and maximum BPM correspond to the smallest and largest BPM value which may be output. In this stage, minimum and maximum values of BPM are limited by the smallest and largest BPM value present in the training data of the k-nearest neighbours-based tempo estimator.

$BPM_{est}$ Modification Using Ceiling and Floor Functions

Electronic music often uses an integer BPM setting. In appreciation of this understanding, in step 8.5 a ceiling and floor function is applied to $BPM_{est}$. As will be known, the ceiling and floor functions give the nearest integer up and down, or the smallest following and largest previous integer, respectively. The result of this stage 8.5 is therefore two sets of data, denoted as floor($BPM_{est}$) and ceil($BPM_{est}$).

The values of floor($BPM_{est}$) and ceil($BPM_{est}$) are used as the BPM value in the second processing path, in which beat tracking is performed on a bass accent signal, or an accent signal dominated by low frequency components, to be described next.

Multi Rate Accent Calculation

A second accent signal ($a_2$) is generated in step 8.6 using the accent signal analysis method described in [3]. The second accent signal ($a_2$) is based on a computationally efficient multi rate filter bank decomposition of the signal. Compared to the $F_0$-salience based accent signal ($a_1$), the second accent signal ($a_2$) is generated in such a way that it relates more to the percussive and/or low frequency content in the inputted music signal and does not emphasize harmonic information. Specifically, in step 8.7, we select the accent signal from the lowest frequency band filter used in step 6.6, as described in [3] so that the second accent signal ($a_2$) emphasizes bass drum hits and other low frequency events. The typical upper limit of this sub-band is 187.5 Hz or 200 Hz may be given as a more general figure. This is performed as a result of the understanding that electronic dance music is often characterized by a stable beat produced by the bass drum.

Figure 12:
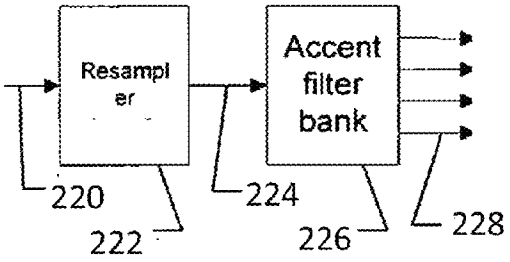
Figure 13:
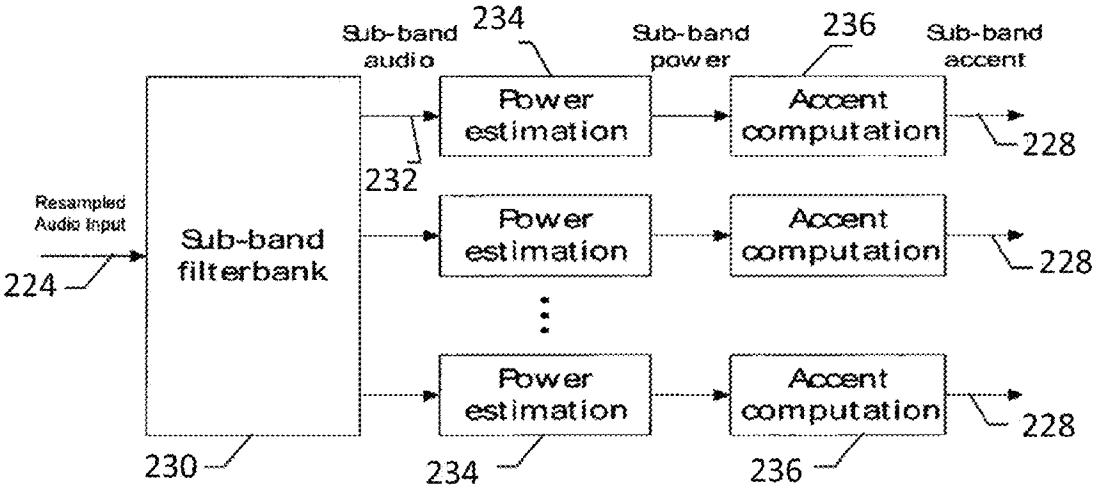
Figure 14:
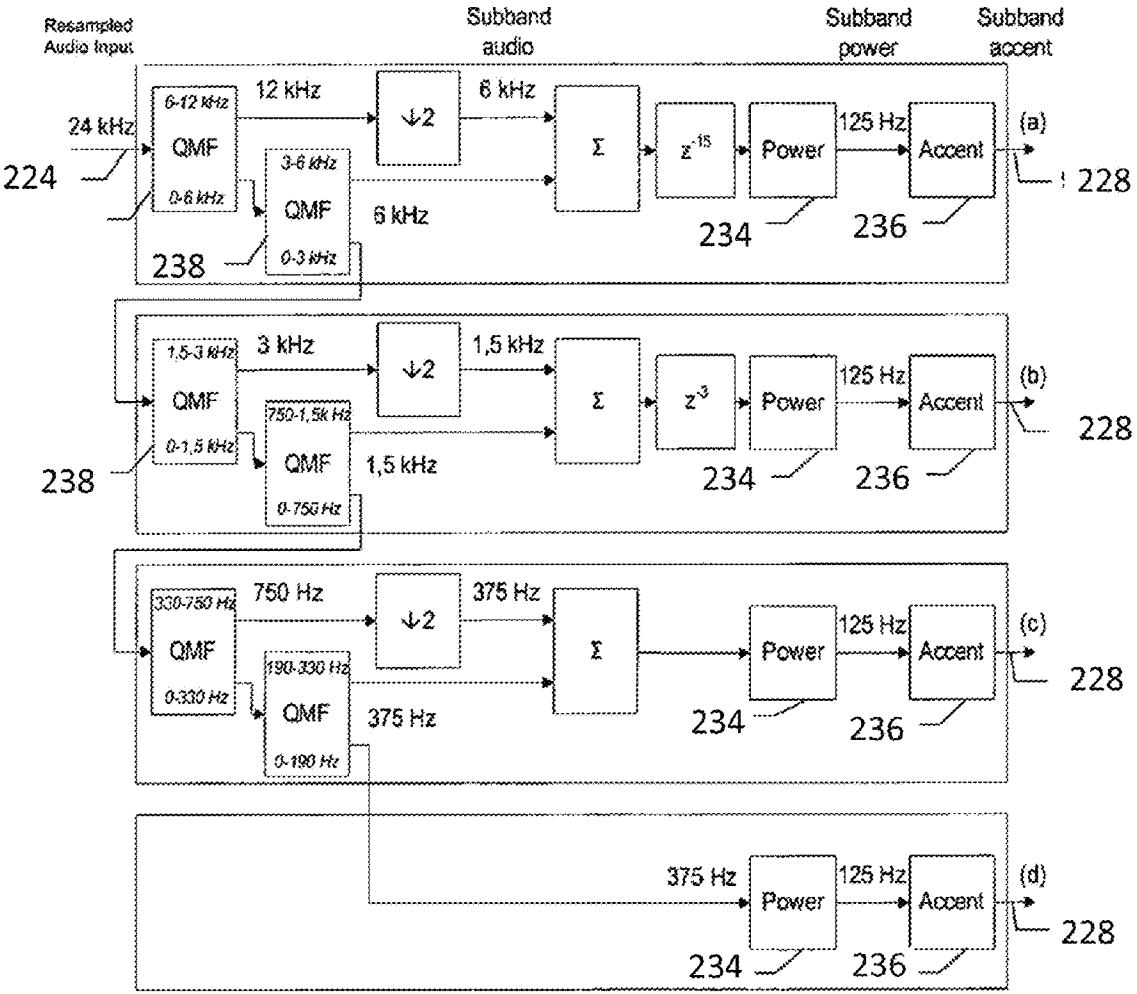

FIGS. 12 to 14 indicate part of the method described in [3], particularly the parts relevant to obtaining the second accent signal ($a_2$) using multi rate filter bank decomposition of the audio signal. Particular reference is also made to the related U.S. Pat. No. 7,612,275 which describes the use of this process. Referring to FIG. 12, part of a signal analyzer is shown, comprising a re-sampler 222 and an accent filter bank 226. The re-sampler 222 re-samples the audio signal 220 at a fixed sample rate. The fixed sample rate may be predetermined, for example, based on attributes of the accent filter bank 226. Because the audio signal 220 is re-sampled at the re-sampler 222, data having arbitrary sample rates may be fed into the analyzer and conversion to a sample rate suitable for use with the accent filter bank 226 can be accomplished, since the re-sampler 222 is capable of performing any necessary up-sampling or down-sampling in order to create a fixed rate signal suitable for use with the accent filter bank 226. An output of the re-sampler 222 may be considered as re-sampled audio input. So, before any audio analysis takes place, the audio signal 220 is converted to a chosen sample rate, for example, in about a 20-30 kHz range, by the re-sampler 222. One embodiment uses 24 kHz as an example realization. The chosen sample rate is desirable because analysis occurs on specific frequency regions. Re-sampling can be done with a relatively low-quality algorithm such as linear interpolation, because high fidelity is not required for successful analysis. Thus, in general, any standard re-sampling method can be successfully applied.

Figure 10:
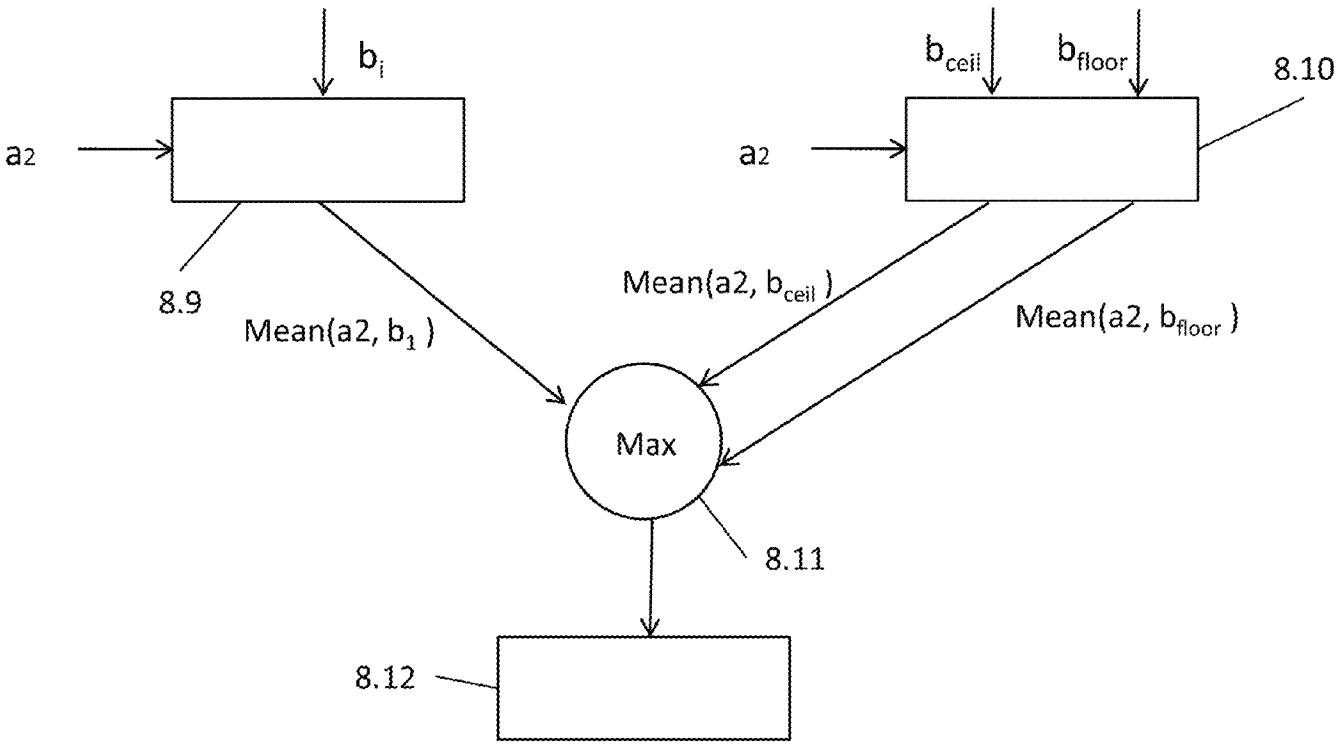

The accent filter bank 226 is in communication with the re-sampler 222 to receive the re-sampled audio input 224 from the re-sampler 22. The accent filter bank 226 implements signal processing in order to transform the re-sampled audio input 224 into a form that is suitable for subsequent analysis. The accent filter bank 226 processes the re-sampled audio input 224 to generate sub-band accent signals 228. The sub-band accent signals 228 each correspond to a specific frequency region of the re-sampled audio input 224. As such, the sub-band accent signals 228 represent an estimate of a perceived accentuation on each sub-band. Much of the original information of the audio signal 220 is lost in the accent filter bank 226 since the sub-band accent signals 228 are heavily down-sampled. It should be noted that although FIG. 10 shows four sub-band accent signals 228, any number of sub-band accent signals 228 are possible. In this application, however, we are only interested in obtaining the lowest sub-band accent signal.

An exemplary embodiment of the accent filter bank 226 is shown in greater detail in FIG. 13. In general, however, the accent filter bank 226 may be embodied as any means or device capable of down-sampling input data. As referred to herein, the term down-sampling is defined as lowering a sample rate, together with further processing, of sampled data in order to perform a data reduction. As such, an exemplary embodiment employs the accent filter bank 226, which acts as a decimating sub-band filter bank and accent estimator, to perform such data reduction. An example of a suitable decimating sub-band filter bank may include quadrature mirror filters as described below.

As shown in FIG. 13, the re-sampled audio signal 224 is first divided into sub-band audio signals 232 by a sub-band filter bank 230, and then a power estimate signal indicative of sub-band power is calculated separately for each band at corresponding power estimation elements 234. Alternatively, a level estimate based on absolute signal sample values may be employed. A sub-band accent signal 228 may then be computed for each band by corresponding accent computation elements 236. Computational efficiency of beat tracking algorithms is, to a large extent, determined by front-end processing at the accent filter bank 226, because the audio signal sampling rate is relatively high such that even a modest number of operations per sample will result in a large number operations per second. Therefore, for this embodiment, the sub-band filter bank 230 is implemented such that the sub-band filter bank may internally down sample (or decimate) input audio signals. Additionally, the power estimation provides a power estimate averaged over a time window, and thereby outputs a signal down sampled once again.

As stated above, the number of audio sub-bands can vary. However, an exemplary embodiment having four defined signal bands has been shown in practice to include enough detail and provides good computational performance. In the current exemplary embodiment, assuming 24 kHz input sampling rate, the frequency bands may be, for example, 0-187.5 Hz, 187.5-750 Hz, 750-3000 Hz, and 3000-12000 Hz. Such a frequency band configuration can be implemented by successive filtering and down sampling phases, in which the sampling rate is decreased by four in each stage. For example, in FIG. 14, the stage producing sub-band accent signal (a) down-samples from 24 kHz to 6 kHz, the stage producing sub-band accent signal (b) down-samples from 6 kHz to 1.5 kHz, and the stage producing sub-band accent signal (c) down-samples from 1.5 kHz to 375 Hz. Alternatively, more radical down-sampling may also be performed. Because, in this embodiment, analysis results are not in any way converted back to audio, actual quality of the sub-band signals is not important. Therefore, signals can be further decimated without taking into account aliasing that may occur when down-sampling to a lower sampling rate than would otherwise be allowable in accordance with the Nyquist theorem, as long as the metrical properties of the audio are retained.

FIG. 14 illustrates an exemplary embodiment of the accent filter bank 226 in greater detail. The accent filter bank 226 divides the resampled audio signal 224 to seven frequency bands (12 kHz, 6 kHz, 3 kHz, 1.5 kHz, 750 Hz, 375 Hz and 125 Hz in this example) by means of quadrature mirror filtering via quadrature mirror filters (QMF) 238. Seven one-octave sub-band signals from the QMFs 102 are combined in four two-octave sub-band signals (a) to (d). In this exemplary embodiment, the two topmost combined sub-band signals (i.e., (a) and (b)) are delayed by 15 and 3 samples, respectively, (at z<−15> and z<−3>, respectively) to equalize signal group delays across sub-bands. The power estimation elements 234 and accent computation elements 236 generate the sub-band accent signal 228 for each sub-band.

For the present application, we are only interested in the lowest sub-band signal representing bass drum beats and/or other low frequency events in the signal. Before outputting, the lowest sub-band accent signal is optionally normalized by dividing the samples with the maximum sample value. Other ways of normalizing, such as mean removal and/or variance normalization could be applied as well. The normalized lowest-sub band accent signal is output as $a_2$.

Second Beat Tracking Stage

In step 8.8 of FIG. 8, second and third beat time sequences ($B_{ceil}$) ($B_{floor}$) are floor, generated.

Inputs to this processing stage comprise the second accent signal ($a_2$) and the values of floor($BPM_{est}$) and ceil($BPM_{est}$) generated in step 8.5. The motivation for this is that, if the music is electronic dance music, it is quite likely that the sequence of beat times will match the peaks in ($a_2$) at either the floor($BPM_{est}$) or ceil($BPM_{est}$).

There are various ways to perform beat tracking using ($a_2$), floor($BPM_{est}$) and ceil($BPM_{est}$). In this case, the second beat tracking stage 8.8 is performed as follows.

Figure 9:
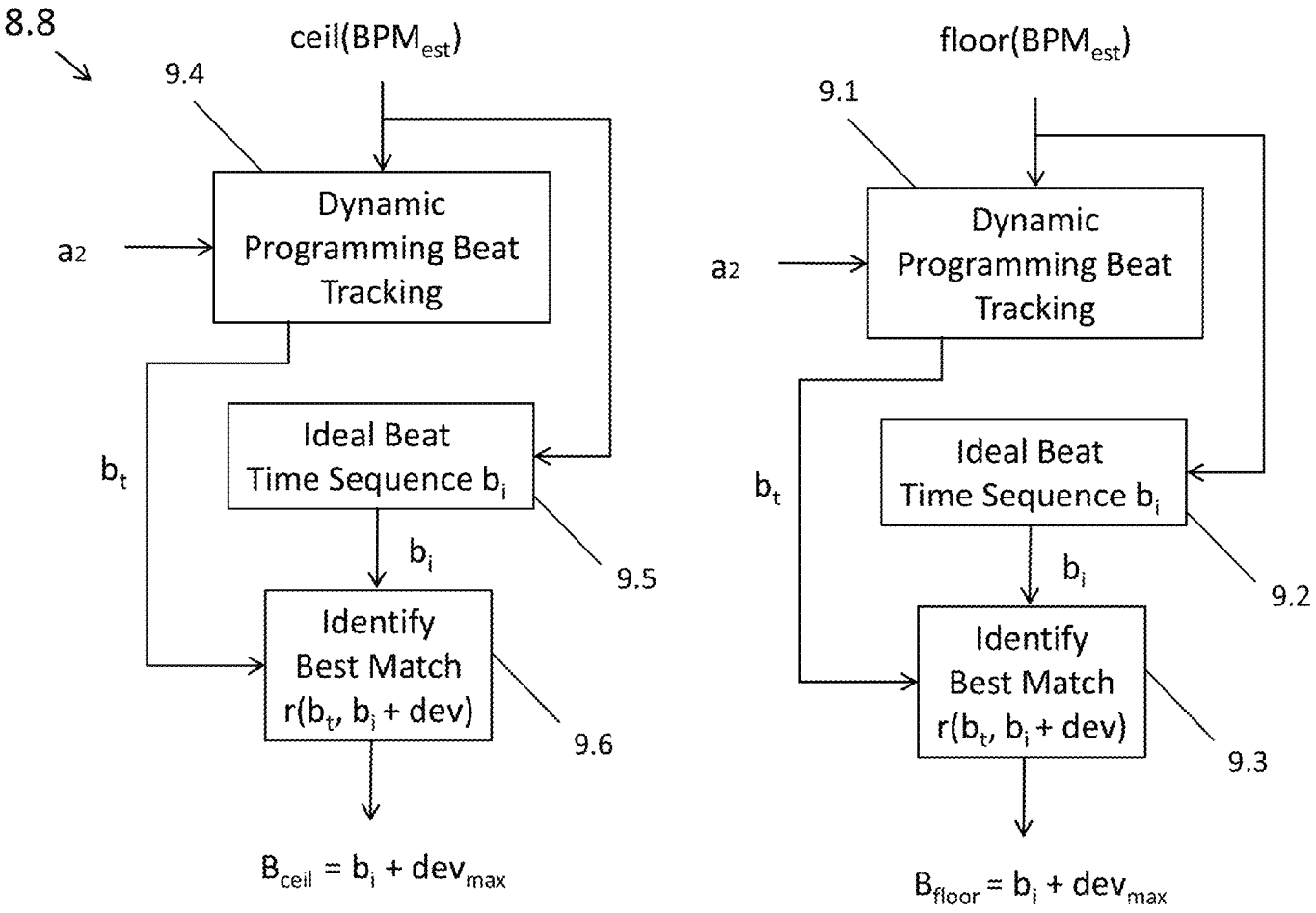
FIGS. 9 to 14 are block diagrams showing processing sub-stages of the system shown in FIG. 8.

Referring to FIG. 9, the dynamic programming beat tracking method described in [7] is performed using the second accent signal ($a_2$) separately applied using each of floor($BPM_{est}$) and ceil($BPM_{est}$). This provides two processing paths shown in FIG. 9, with the dynamic programming beat tracking steps being indicated by reference numerals 9.1 and 9.4.

The following paragraph describes the process for just one path, namely that applied to floor($BPM_{est}$) but it will be appreciated that the same process is performed in the other path applied to ceil($BPM_{est}$). As before, the reference numerals relating to the two processing paths in no way indicate order of processing; it is possible that both paths can operate in parallel.

The dynamic programming beat tracking method of step 9.1 gives an initial beat time sequence $b_t$. Next, in step 9.2 an ideal beat time sequence $b_i$ is calculated as:

$$b_i=0,1/(\text{floor}(BPM_{est})/60),2/(\text{floor}(BPM_{est})/60),\text{ etc.}$$

Next, in step 9.3 a best match is found between the initial beat time sequence $b_t$ and the ideal beat time sequence $b_i$ when $b_i$ is offset by a small amount. For finding the match, we use the criterion proposed in [1] for measuring the similarity of two beat time sequences. We evaluate the score $R(b_t, b_i+\text{dev})$ where R is the criterion for tempo tracking accuracy proposed in [1], and dev is a deviation ranging from 0 to $1.1/(\text{floor}(BPM_{est})/60)$ with steps of $0.1/(\text{floor}(BPM_{est})/60)$. Note that the step is a parameter and can be varied. In Matlab language, the score R can be calculated as

```
function R=beatscore_cemgil(bt, at)
sigma_e=0.04; % expected onset spread
% match nearest beats
id=nearesnat(:)',bt(:));
% compute distances
    d=at−bt(id);
% compute tracking index
    s=exp(−d.^2/(2*sigma_e^2));
    R=2*sum(s)/(length(bt)+length(at));
```

The input 'bt' into the routine is $b_t$, and the input 'at' at each iteration is $b_i$+dev. The function 'nearest' finds the nearest values in two vectors and returns the indices of values nearest to 'at' in 'bt'. In Matlab language, the function can be presented as

```
function n=nearest(x,y)
% x row vector
% y column vector:
% indices of values nearest to x's in y
x=ones(size(y,1),1)*x;
[junk,n]=min(abs(x−y));
```

The output is the beat time sequence $b_i+\text{dev}_{max}$, where $\text{dev}_{max}$ is the deviation which leads to the largest score R. It should be noted that scores other than R could be used here as well. It is desirable that the score measures the similarity of the two beat sequences.

As indicated above, the process is performed also for ceil ($BPM_{est}$) in steps 9.4, 9.5 and 9.6 with values of floor($BPM_{est}$) being changed accordingly from the above paragraph.

The output from steps 9.3 and 9.6 are the two beat time sequences: $B_{ceil}$ which is based on ceil($BPM_{est}$) and $B_{floor}$ based on floor($BPM_{est}$). Note that these beat sequences have a constant beat interval. That is, the period of two adjacent beats is constant throughout the beat time sequences.

Selection of Beat Time Sequence

Referring back to FIG. 8, as a result of the first and second beat tracking stages 8.4, 8.8 we have three beat time sequences:

$b_1$ based on the chroma accent signal and the real BPM value $BPM_{est}$;

$b_{ceil}$ based on ceil($BPM_{est}$); and $b_{floor}$ based on floor($BPM_{est}$).

The remaining processing stages 8.9, 8.10, 8.11 determine which of these best explains the accent signals obtained. For this purpose, we could use either or both of the accent signals $a_1$ or $a_2$. More accurate and robust results have been observed using just $a_2$, representing the lowest band of the multi rate accent signal.

As indicated in FIG. 10, a scoring system is employed, as follows: first, we separately calculate the mean of accent signal $a_2$ at times corresponding to the beat times in each of $b_1$, $b_{ceil}$, and $b_{floor}$. In step 8.11, whichever beat time sequence gives the largest mean value of the accent signal $a_2$ is considered the best match and is selected as the output beat time sequence in step 8.12. Instead of the mean or average, other measures such as geometric mean, harmonic mean, median, maximum, or sum could be used.

As an implementation detail, a small constant deviation of maximum+/−ten-times the accent signal sample period is allowed in the beat indices when calculating the average accent signal value. That is, when finding the average score, the system iterates through a range of deviations, and at each iteration adds the current deviation value to the beat indices and calculates and stores an average value of the accent signal corresponding to the displaced beat indices. In the end, the maximum average value is found from the average values corresponding to the different deviation values, and outputted. This step is optional, but has been found to increase the robustness since with the help of the deviation it is possible to make the beat times to match with peaks in the accent signal more accurately. Furthermore, optionally, the individual beat indices in the deviated beat time sequence may be deviated as well. In this case, each beat index is deviated by maximum of −/+one sample, and the accent signal value corresponding to each beat is taken as the maximum value within this range when calculating the average. This allows for accurate positions for the individual beats to be searched. This step has also been found to slightly increase the robustness of the method.

Intuitively, the final scoring step performs matching of each of the three obtained candidate beat time sequences $b_1$, $B_{ceil}$, and $B_{floor}$ to the accent signal $a_2$, and selects the one which gives a best match. A match is good if high values in the accent signal coincide with the beat times, leading into a high average accent signal value at the beat times. If one of the beat sequences which is based on the integer BPMs, i.e. $B_{ceil}$, and $B_{floor}$, explains the accent signal $a_2$ well, that is, results in a high average accent signal value at beats, it will be selected over the baseline beat time sequence $b_1$. Experimental data has shown that this is often the case when the inputted music signal corresponds to electronic dance music (or other music with a strong beat indicated by the bass drum and having an integer valued tempo), and the method significantly improves performance on this style of music. When $B_{ceil}$ and $B_{floor}$ do not give a high enough average value, then the beat sequence $b_1$ is used. This has been observed to be the case for most music types other than electronic music.

Instead of using the ceil($BPM_{est}$) and floor($BPM_{est}$), the method could operate also with a single integer valued BPM estimate. That is, the method calculates, for example, one of round($BPM_{est}$), ceil($BPM_{est}$) and floor($BPM_{est}$), and performs the beat tracking using that using the low-frequency accent signal $a_2$. In some cases, conversion of the BPM value to an integer might be omitted completely, and beat tracking performed using $BPM_{est}$ on $a_2$.

In cases where the tempo estimation step produces a sequence of BPM values over different temporal locations of the signal, the tempo value used for the beat tracking on the accent signal az could be obtained, for example, by averaging or taking the median of the BPM values. That is, in this case the method could perform the beat tracking on the accent signal $a_1$ which is based on the chroma accent features, using the framewise tempo estimates from the tempo estimator. The beat tracking applied on $a_2$ could assume constant tempo, and operate using a global, averaged or median BPM estimate, possibly rounded to an integer.

In summary, the audio analysis process performed by the controller 202 under software control involves the steps of:

obtaining a tempo (BPM) estimate and a first beat time sequence using a combination of the methods described in [2] and [7];

obtaining an accent signal emphasizing low-frequency band accents using the method described in [3];

calculating the integer ceil and floor of the tempo estimate;

calculating a second and third beat time sequence using the accent signal and the integer ceil and floor of the tempo estimate;

calculating a 'goodness' score for the first, second, and third beat time sequence using the accent signal; and outputting the beat time sequence which corresponds to the best goodness score.

Downbeat Determination 603

Figure 15:
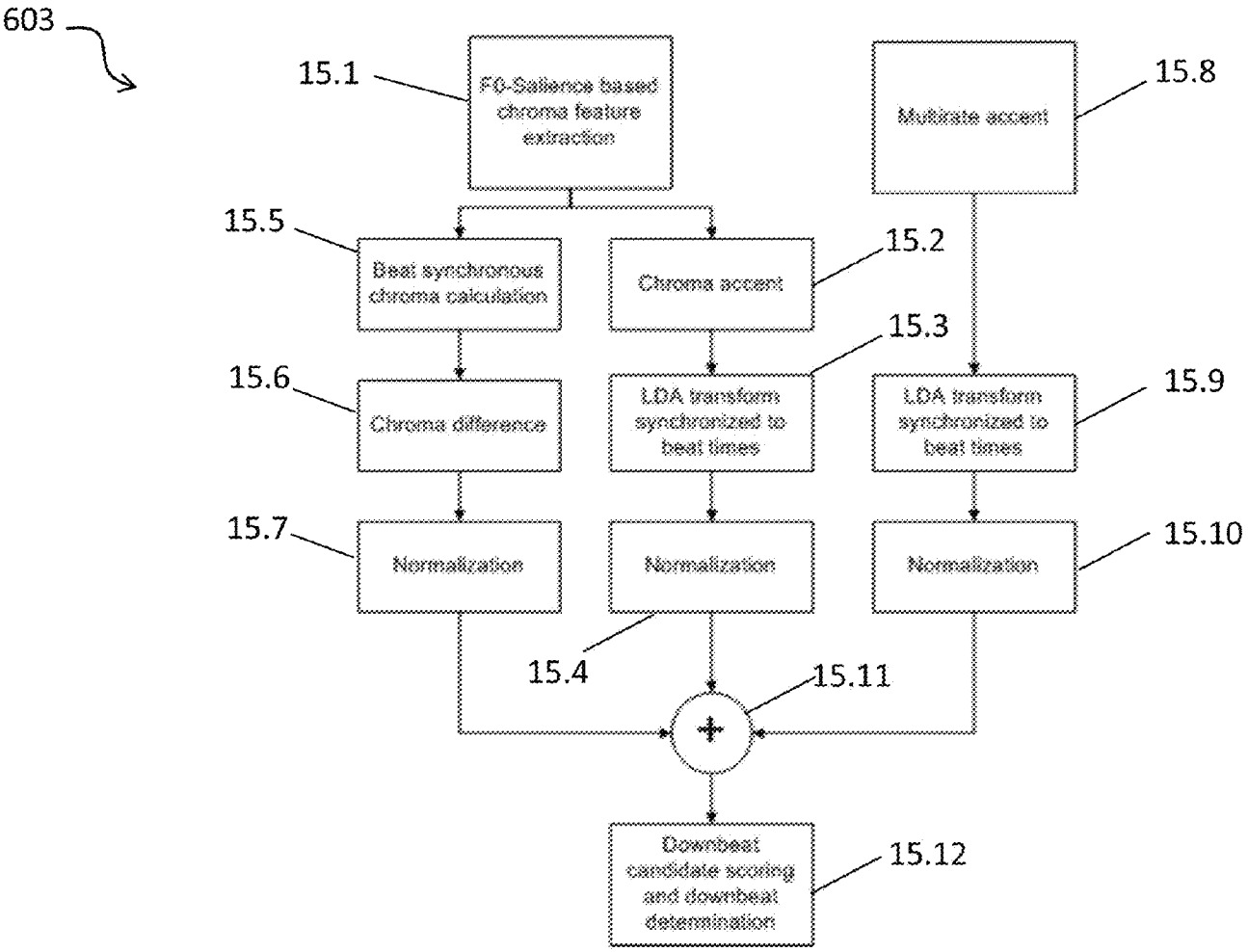
FIG. 15 is a block diagram showing processing stages performed by a downbeat determination sub-stage shown in FIG. 7.

A suitable method is that which is described in Applicant's co-pending patent application number PCT/IB2012/052157 which for completeness is described here with reference to FIG. 15.

It will be seen that three processing paths are defined (left, middle, right); the reference numerals applied to each processing stage are not indicative of order of processing. In some implementations, the three processing paths might be performed in parallel allowing fast execution. In overview, the above-described beat tracking is performed to identify or estimate beat times in the audio signal. Then, at the beat times, each processing path generates a numerical value representing a differently-derived likelihood that the current beat is a downbeat. These likelihood values are normalised and then summed in a score-based decision algorithm that identifies which beat in a window of adjacent beats is a downbeat.

Steps 15.1 and 15.2 are identical to steps 8.1 and 8.6 shown in FIG. 8, i.e. which form part of the tempo and beat tracking method. In downbeat determination, the task is to determine which of the beat times correspond to downbeats, that is the first beat in the bar or measure.

Chroma Difference Calculation & Chord Change Possibility

The left-hand path (steps 15.5 and 15.6) calculates what the average pitch chroma is at the aforementioned beat locations and infers a chord change possibility which, if high, is considered indicative of a downbeat. Each step will now be described.

Beat Synchronous Chroma Calculation

In step 15.5, the method described in [2] is employed to obtain the chroma vectors and the average chroma vector is calculated for each beat location. Alternatively, any suitable method for obtaining the chroma vectors might be employed. For example, a computationally simple method would use the Fast Fourier Transform (FFT) to calculate the short-time spectrum of the signal in one or more frames corresponding to the music signal between two beats. The chroma vector could then be obtained by summing the magnitude bins of the FFT belonging to the same pitch class. Such a simple method may not provide the most reliable chroma and/or chord change estimates but may be a viable solution if the computational cost of the system needs to be kept very low.

Instead of calculating the chroma at each beat location, a sub-beat resolution could be used. For example, two chroma vectors per each beat could be calculated.

Chroma Difference Calculation

Next, in step 15.6, a "chord change possibility" is estimated by differentiating the previously determined average chroma vectors for each beat location.

Trying to detect chord changes is motivated by the musicological knowledge that chord changes often occur at downbeats. The following function is used to estimate the chord change possibility:

$$\text{Chord_change}(t_i) = \sum_{j=1}^{12}\sum_{k=1}^{3}|\bar{c}_j(t_i) - \bar{c}_j(t_{i-k})| - \sum_{j=1}^{12}\sum_{k=1}^{3}|\bar{c}_j(t_i) - \bar{c}_j(t_{i+k})|$$

The first sum term in Chord_change($t_i$) represents the sum of absolute differences between the current beat chroma vector and the three previous chroma vectors. The second sum term represents the sum of the next three chroma vectors. When a chord change occurs at beat $t_i$, the difference between the current beat chroma vector $\bar{c}(t_i)$ and the three previous chroma vectors will be larger than the difference between $\bar{c}(t_i)$ and the next three chroma vectors. Thus, the value of Chord_change($t_i$) will peak if a chord change occurs at time $t_i$.

Similar principles have been used in [1] and [6], but the actual computations differ.

Alternatives and variations for the Chord_change function include, for example: using more than 12 pitch classes in the summation of j. In some embodiments, the value of pitch classes might be, e.g., 36, corresponding to a $\frac{1}{3}^{rd}$ semitone resolution with 36 bins per octave. In addition, the function can be implemented for various time signatures. For example, in the case of a ¾ time signature the values of k could range from 1 to 2. In some other embodiments, the amount of preceding and following beat time instants used in the chord change possibility estimation might differ. Various other distance or distortion measures could be used, such as Euclidean distance, cosine distance, Manhattan distance, Mahalanobis distance. Also statistical measures could be applied, such as divergences, including, for example, the Kullback-Leibler divergence. Alternatively, similarities could be used instead of differences. The benefit of the Chord_change function above is that it is computationally very simple.

Chroma Accent and Multirate Accent Calculation

Regarding the central path (steps 15.2, 15.3) the process of generating the salience-based chroma accent signal has already been described above in relation to beat tracking. The chroma accent signal is applied at the determined beat instances to a linear discriminant transform (LDA) in step 15.3, mentioned below.

Regarding the right hand path (steps 15.8, 15.9) another accent signal is calculated using the accent signal analysis method described in [3]. This accent signal is calculated using a computationally efficient multi rate filter bank decomposition of the signal.

When compared with the previously described $F_0$ salience-based accent signal, this multi rate accent signal relates more to drum or percussion content in the signal and does not emphasise harmonic information. Since both drum patterns and harmonic changes are known to be important for downbeat determination, it is attractive to use/combine both types of accent signals.

LDA Transform of Accent Signals

The next step performs separate LDA transforms at beat time instants on the accent signals generated at steps 15.2 and 15.8 to obtain from each processing path a downbeat likelihood for each beat instance.

The LDA transform method can be considered as an alternative for the measure templates presented in [5]. The idea of the measure templates in [5] was to model typical accentuation patterns in music during one measure. For example, a typical pattern could be low, loud, —, loud, meaning an accent with lots of low frequency energy at the first beat, an accent with lots of energy across the frequency spectrum on the second beat, no accent on the third beat, and again an accent with lots of energy across the frequency spectrum on the fourth beat. This corresponds, for example, to the drum pattern bass, snare, -, snare.

The benefit of using LDA templates compared to manually-designed rhythmic templates is that they can be trained from a set of manually annotated training data, whereas the rhythmic templates were manually obtained. This increases the downbeat determination accuracy based on our simulations.

Using LDA for beat determination was suggested in [1]. Thus, the main difference between [1] and the present embodiment is that here we use LDA trained templates for discriminating between "downbeat" and "beat", whereas in [1] the discrimination was done between "beat" and "non-beat".

Referring to [1] it will be appreciated that LDA analysis involves a training phase and an evaluation phase.

In the training phase, LDA analysis is performed twice, separately for the salience-based chroma accent signal (from step 15.2) and the multirate accent signal (from step 15.8).

The chroma accent signal from step 15.2 is a one dimensional vector.

The training method for both LDA transform stages (steps 15.3, 15.9) is as follows:

1) sample the accent signal at beat positions;

2) go through the sampled accent signal at one beat steps, taking a window of four beats in turn;

3) if the first beat in the window of four beats is a downbeat, add the sampled values of the accent signal corresponding to the four beats to a set of positive examples;

4) if the first beat in the window of four beats is not a downbeat, add the sampled values of the accent signal corresponding to the four beats to a set of negative examples;

5) store all positive and negative examples. In the case of the chroma accent signal from step 6.2, each example is a vector of length four;

6) after all the data has been collected (from a catalogue of songs with annotated beat and downbeat times), perform LDA analysis to obtain the transform matrices.

When training the LDA transform, it is advantageous to take as many positive examples (of downbeats) as there are negative examples (not downbeats). This can be done by randomly picking a subset of negative examples and making the subset size match the size of the set of positive examples.

7) collect the positive and negative examples in an M by d matrix [X]. M is the number of samples and d is the data dimension. In the case of the chroma accent signal from step 15.2, d=4.

9) Normalize the matrix [X] by subtracting the mean across the rows and dividing by the standard deviation.

10) Perform LDA analysis as is known in the art to obtain the linear coefficients W. Store also the mean and standard deviation of the training data.

In the online downbeat detection phase (i.e. the evaluation phases steps 15.3 and 15.9) the downbeat likelihood is obtained using the method:

for each recognized beat time, construct a feature vector x of the accent signal value at the beat instant and three next beat time instants;

subtract the mean and divide with the standard deviation of the training data the input feature vector x;

calculate a score x*W for the beat time instant, where x is a 1 by d input feature vector and W is the linear coefficient vector of size d by 1.

A high score may indicate a high downbeat likelihood and a low score may indicate a low downbeat likelihood.

In the case of the chroma accent signal from step 15.2, the dimension d of the feature vector is 4, corresponding to one accent signal sample per beat. In the case of the multirate accent signal from step 15.8, the accent has four frequency bands and the dimension of the feature vector is 16.

The feature vector is constructed by unraveling the matrix of bandwise feature values into a vector.

In the case of time signatures other than 4/4, the above processing is modified accordingly. For example, when training a LDA transform matrix for a ¾ time signature, the accent signal is travelled in windows of three beats. Several such transform matrices may be trained, for example, one corresponding to each time signature the system needs to be able to operate under.

Various alternatives to the LDA transform are possible. These include, for example, training any classifier, predictor, or regression model which is able to model the dependency between accent signal values and downbeat likelihood. Examples include, for example, support vector machines with various kernels, Gaussian or other probabilistic distributions, mixtures of probability distributions, k-nearest neighbour regression, neural networks, fuzzy logic systems, decision trees, and so on. The benefit of the LDA is that it is straightforward to implement and computationally simple.

Downbeat Candidate Scoring and Downbeat Determination

When the audio has been processed using the above-described steps, an estimate for the downbeat is generated by applying the chord change likelihood and the first and second accent-based likelihood values in a non-causal manner to a score-based algorithm. Before computing the final score, the chord change possibility and the two downbeat likelihood signals are normalized by dividing with their maximum absolute value (see steps 15.4, 15.7 and 15.10).

The possible first downbeats are $t_1$, $t_2$, $t_3$, $t_4$ and the one that is selected is the one maximizing:

$$\text{score}(t_n) = \frac{1}{\text{card}(S(t_n))} \sum_{j \in S(t_n)} (w_c \text{Chord_change}(j) + w_a a(j) + w_m m(j)),$$

$n=1, \ldots, 4S(t_n)$ is the set of beat times $t_n$, $t_{n+4}$, $t_{n+8}$, . . . .

$w_c$, $w_a$, and $w_m$ are the weights for the chord change possibility, chroma accent based downbeat likelihood, and multirate accent based downbeat likelihood, respectively. Step 15.11 represents the above summation and step 15.12 the determination based on the highest score for the window of possible downbeats.

Note that the above scoring function was presented in the case of a 4/4 time signature. Other time signatures could be analysed also, such as ¾ where there are three beats per measure. This disclosure relates only to the most common 4/4 time signature but the method can be generalised to other time signatures using suitable training parameters.

Signal Analysis and Scoring Modules 607

Figure 16:
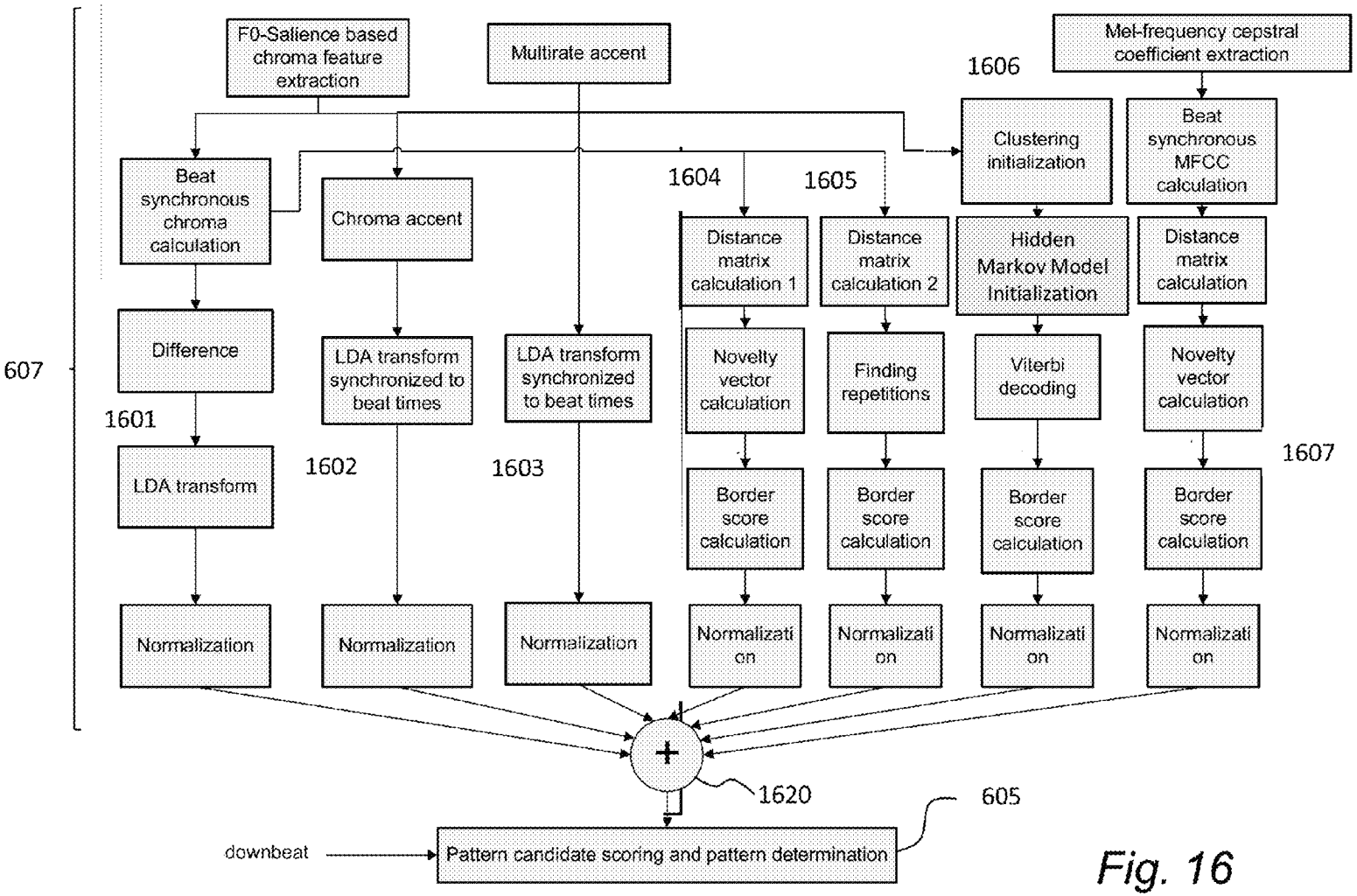
FIG. 16 is a block diagram showing processing stages performed by a signal analysis module and a scoring and pattern determination module shown in FIG. 7.

Referring now to FIG. 16, we describe multiple (seven) signal analysis and pattern scoring methods each of which generates a normalised score representing either the likelihood of the signal (at a given time or beat) being at the start of a repeating pattern and/or whether the signal is at the boundary of a section change, e.g. from verse to chorus. Each method is represented in the Figure as a separate stream of processing stages, labelled 1601-1607. The normalised score from each stream 1601-1607 is summed at stage 1620 and passed to the pattern candidate scoring and determination module 605. This stage 605 determines which beats of the music signal correspond to the start of a musical pattern.

Note that any one of the seven signal analysis and pattern scoring methods can be used to generate a score from which can be identified the start of a repeating pattern.

Alternatively, two or more processing streams can be used in any combination. Here, we present a system and method which uses multiple (seven) processing streams each of which uses a different signal analysis method.

The aim in this module 605 is to group measures into patterns of two adjacent measures. Each pattern is thus eight beats long given that we are considering the time signature of 4/4. If we generalized the method to other time signatures, e.g. a ¾time signature, then we would look for patterns of six beats. We could identify patterns longer than two measures, e.g. patterns of three or four measures.

There are two characteristics for such a music pattern. A music pattern consists of groups of musical measures, which means that the beats at the start of music patterns are also downbeats. In addition, we want some of the pattern beginnings to coincide with the beginnings of musical sections, such as the intro, verse, chorus, outro, and so on. Note that all of the pattern beginnings do not necessarily correspond to section beginnings, but we want to adjust the pattern phase such that maximal pattern times actually coincide with musical section boundaries.

Since pattern beginnings are also downbeats, the music analysis methods may utilize similar stages as have been used in the downbeat detector (FIG. 15: 603) such as how likely it is that there is a chord change happening on the beat because we know that in music a chord often changes at downbeats. Since pattern beginnings should coincide with structural changes, the pattern detector should also utilize information which indicates the possible beginning of a musical section.

Not all downbeats coincide with the beginning of a musical section. However, when a downbeat does coincide with the beginning of a musical section, we refer to this downbeat as a fundamental downbeat. The name indicates intuitively that this downbeat is more important than other downbeats in the same song, because of the accent, strength, polyphonic structure or other musical features that makes it audibly different. The fundamental downbeat (and all its instances during a song) may trigger specific actions in particular applications. For example, in an automated video editing application, a video cut could always be performed upon the occurrence of a fundamental downbeat, or a special visual effect may be displayed on a fundamental downbeat. In general, a strong visual effect in an image or a video sequence may be in proximity to, or placed at the same time instant as, a fundamental downbeat.

With the above in mind, referring to FIG. 16, it will be seen that the first three processing streams 1601, 1602 and 1603 are nearly identical to those of the downbeat determination module 603 shown in FIG. 15. Thus, similar calculations can be performed twice; first for the downbeat determination and then, separately, to obtain three pattern scores from each of streams 1601, 1602 and 1603. One difference in the first stream 1601 is that a LDA transform is applied after the chroma difference stage. Each of the three streams 1601, 1602 and 1603 now use LDA template transforms as described above with reference to FIG. 15, although in this case with the templates trained to discriminate between the beginnings of music patterns and other beats, rather than just detecting downbeats. The training method is the same for downbeat detection but now the two classes are "first beat of pattern" and "other beat". The patterns are identified as eight beats long (whereas for downbeat detection they are four beats long).

The output from each of the three streams 1601, 1602 and 1603 is normalised and provides a respective pattern score for each which is fed to the summing module 1620.

The other four processing streams 1604, 1605, 1606 and 1607 will now be described in detail. As mentioned above, in this embodiment we wish the beginnings of music patterns to coincide mostly with the beginnings of musical sections. These four branches 1604, 1605, 1606 and 1607 extract signals and generate a pattern score which indicates the likelihood of a section change.

approach which shows peaks where there is locally-novel audio and provides a measure of how likely it is that there is a change in the signal at a given time or beat. Border candidates are generated using the novelty detection method in [9] which has been used as a part of the music structure analysis system described in [10]. Reference [11] is also useful for background. The novelty score for each beat acts as a partial indication as to whether there is a structural change and also a pattern beginning at that beat.

An example of a ten by ten checkerboard kernel is given below:

| | | | | | | | | | |
|---|---|---|---|---|---|---|---|---|---|
| −0.0392 | −0.0743 | −0.1200 | −0.1653 | −0.1940 | 0.1940 | 0.1653 | 0.1200 | 0.0743 | 0.0392 |
| −0.0743 | −0.1409 | −0.2276 | −0.3135 | −0.3679 | 0.3679 | 0.3135 | 0.2276 | 0.1409 | 0.0743 |
| −0.1200 | −0.2276 | −0.3679 | −0.5066 | −0.5945 | 0.5945 | 0.5066 | 0.3679 | 0.2276 | 0.1200 |
| −0.1653 | −0.3135 | −0.5066 | −0.6977 | −0.8187 | 0.8187 | 0.6977 | 0.5066 | 0.3135 | 0.1653 |
| −0.1940 | −0.3679 | −0.5945 | −0.8187 | −0.9608 | 0.9608 | 0.8187 | 0.5945 | 0.3679 | 0.1940 |
| 0.1940 | 0.3679 | 0.5945 | 0.8187 | 0.9608 | −0.9608 | −0.8187 | −0.5945 | −0.3679 | −0.1940 |
| 0.1653 | 0.3135 | 0.5066 | 0.6977 | 0.8187 | −0.8187 | −0.6977 | −0.5066 | −0.3135 | −0.1653 |
| 0.1200 | 0.2276 | 0.3679 | 0.5066 | 0.5945 | −0.5945 | −0.5066 | −0.3679 | −0.2276 | −0.1200 |
| 0.0743 | 0.1409 | 0.2276 | 0.3135 | 0.3679 | −0.3679 | −0.3135 | −0.2276 | −0.1409 | −0.0743 |
| 0.0392 | 0.0743 | 0.1200 | 0.1653 | 0.1940 | −0.1940 | −0.1653 | −0.1200 | −0.0743 | −0.0392 |

Stream 1604

The inputs to the fourth stream 1604 are the beat synchronous chroma vectors obtained previously at the start of the first stream 1601. Such vectors are used to construct a so-called self distance matrix (SDM) which is a two dimensional representation of the similarity of an audio signal when compared with itself over all time frames. An entry d(i,j) in this SDM represents the Euclidean distance between the beat synchronous chroma vectors at beats i and j. A similar SDM is described in U.S. Pat. No. 7,659,471 for music chorus detection and the contents of this US patent are incorporated herein by reference.

Figure 17:
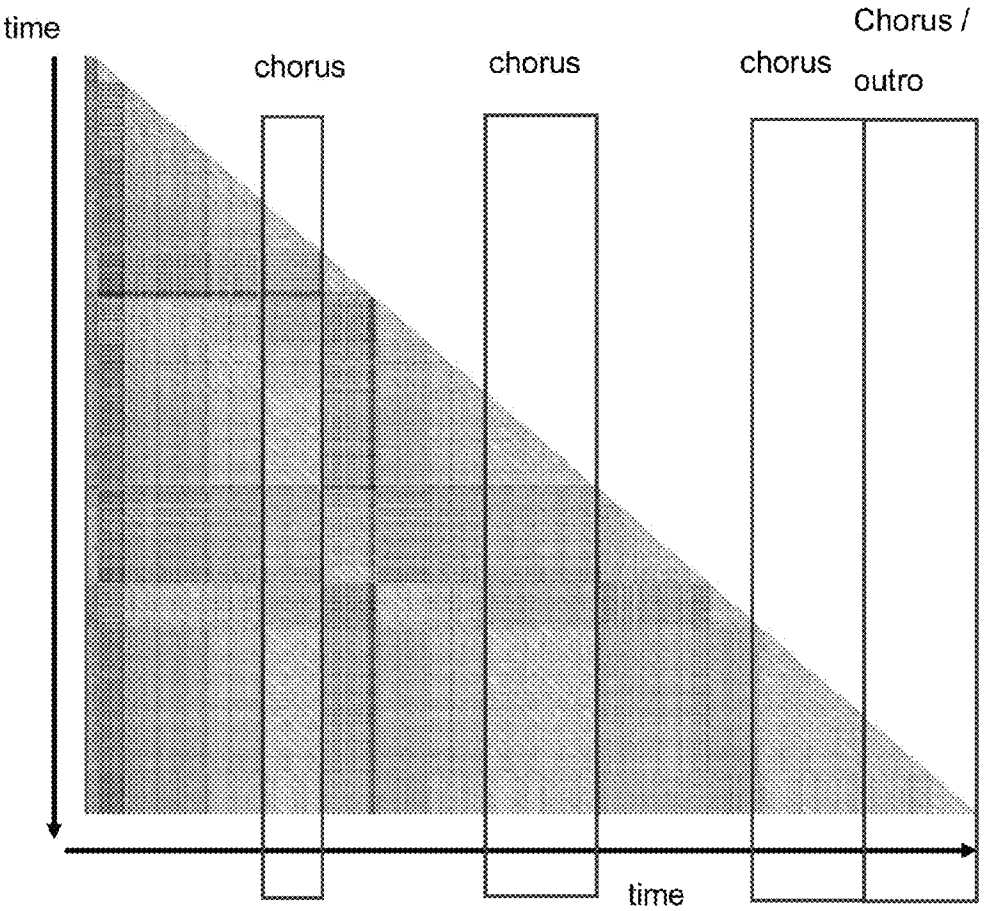
FIG. 17 is an example of a self-distance matrix (SDM), which is useful for understanding the invention.

An example SDM for a musical signal is depicted in FIG. 17. The main diagonal line is where the same part of the signal is compared with itself; otherwise, the shading (only the lower half of the SDM is shown for clarity) indicates by its various levels the degree of difference/similarity. By detecting off-diagonal stripes representing low distances, one can detect repetitions in the music. Here, downbeats which begin each chorus section (fundamental downbeats) are visible and detectable using known analysis techniques.

Figure 18:
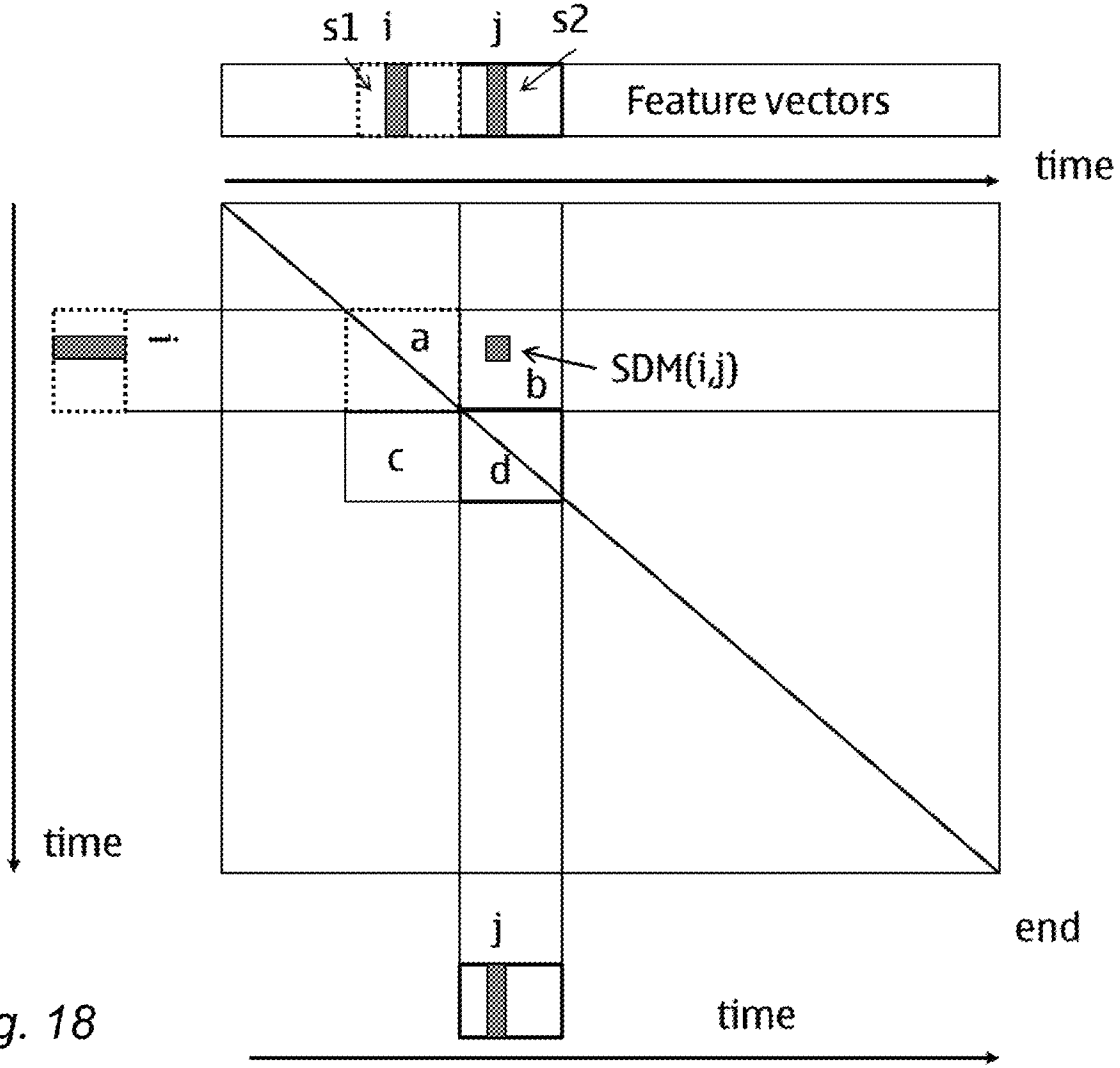
FIG. 18 is a schematic representation of a SDM, which is useful for understanding the principle of forming such an SDM.

FIG. 18 is useful for understanding the principle of creating a SDM. If there are two audio segments s1 and s2, such that inside a musical segment the feature vectors are quite similar to one other, and between the segments the feature vectors are less similar, then there will be a checkerboard pattern on corresponding SDM locations. More specifically, the area marked 'a' denotes distances between the feature vectors belonging to segment s1 and thus the distances are quite small. Similarly, segment 'd' is the area corresponding to distances between the feature vectors belonging to the segment s2, and these distances are also quite small. The areas marked 'b' and 'c' correspond to distances between the feature vectors of segments s1 and s2, that is, distances across these segments. Thus, if these segments are not very similar to each other (for example, at a musical section change having a different instrumentation and/or harmony) then these areas will have a larger distance and will be shaded accordingly.

Performing correlation along the main diagonal with a checkerboard kernel will emphasise this kind of pattern, as described in [9]. Indeed, the next step involves determining a novelty score using the self distance matrix (SDM). The novelty score results from the correlation of the checkerboard kernel along the main diagonal; this is a matched filter Note that the actual values and the exact size of the kernel may be varied. This kernel is passed along with the main diagonal of one or more SDMs and the novelty score at each beat is calculated by a point wise multiplication of the kernel and the SDM values. To calculate the novelty score for a frame at index j, the kernel top left corner is positioned at the location j-kernelSize/2+1, j-kernelSize/2+1, pointwise multiplication is performed between the kernel and the corresponding SDM values, and the resulting values are summed.

The novelty score for each beat is normalized by dividing with the maximum absolute value, and this is passed to the summing module 1620.

Stream 1605

The inputs to the fifth stream 1605 are also the beat synchronous chroma vectors obtained previously. Such vectors are used to construct a self distance matrix (SDM) in the same way as for stream 1604, but in this case the difference between chroma vectors is calculated using the so-called Pearson correlation coefficient instead of Euclidean distance. Cosine distances or the Euclidean distance could be used as an alternative. The Pearson coefficient is suggested in [8] and is a well known measure of linear dependence between two variables.

The next stage involves identifying repetitions in the SDM. As noted above, diagonal lines which are parallel to the main diagonal are indicative of a repeating audio in the SDM, as one can observe from the locations of chorus sections in FIG. 17. U.S. Pat. No. 7,659,471 proposes in detail one way of finding such repetitions. Another method of locating repetitions is described in [8] with a two-stage automatic segmentation algorithm. First, approximately repeated chroma sequences are located and a greedy algorithm used to decide which of the sequences are indeed musical segments. Pearson correlation coefficients are obtained between every pair of chroma vectors, which together represent the beat-wise SDM.

In order to eliminate short term noise, a median filter of length five is run diagonally over the SDM. Next, repetitions of eight beats in length are identified from the filtered SDM.

Figure 19:
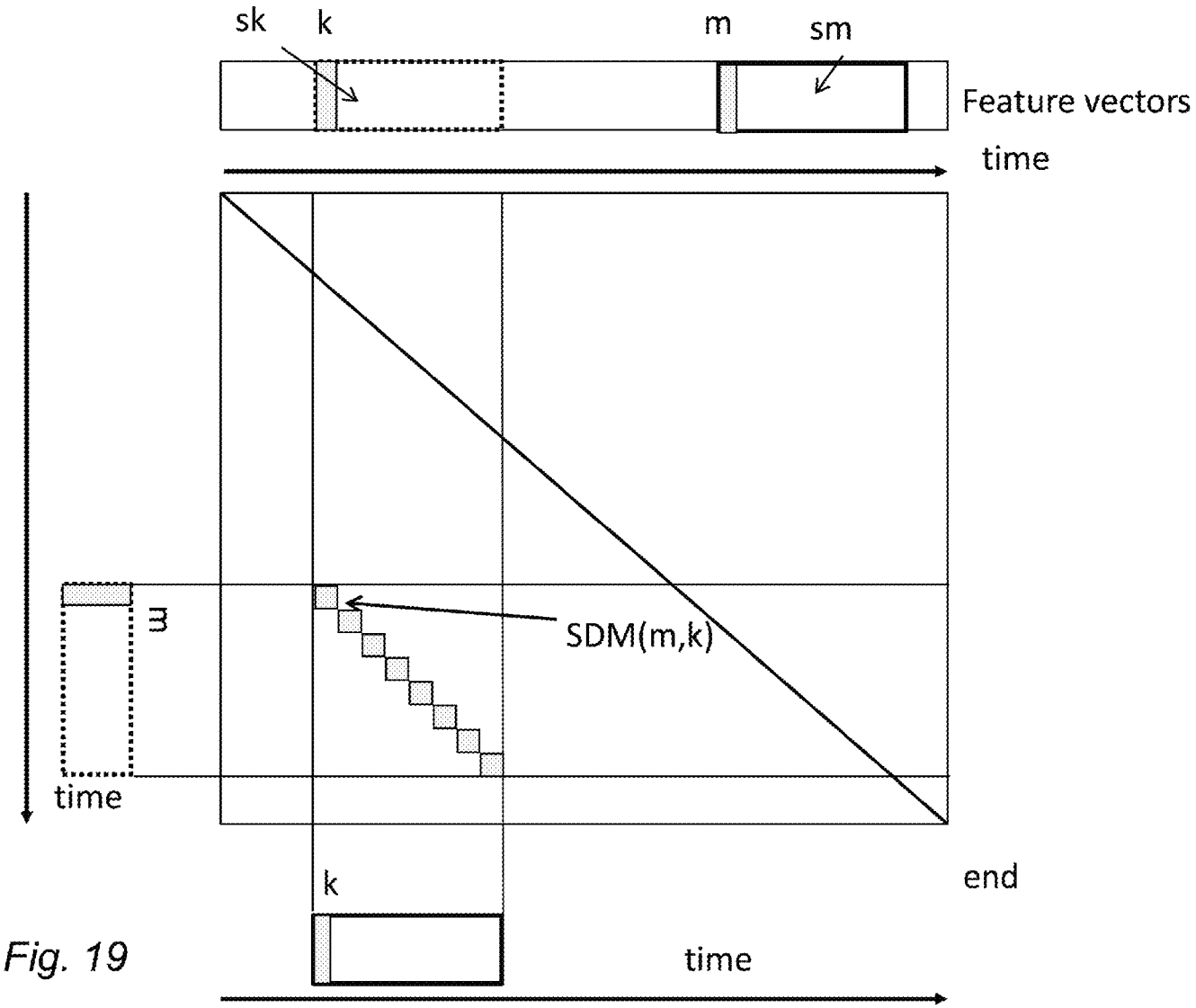
FIG. 19 is a schematic representation of a SDM in which a repeating musical segment of a given length is shown represented.

A repetition of length L beats is defined as a diagonal segment in the SDM, starting at coordinates (m, k) and ending at (m+L−1, k+L−1), where the mean correlation value is high enough. This means that the L beat long section of the track starting at beat m repeats at beat k. Such a repetition caused by "segment sk starting at beat k repeating as segment sm starting at beat m" is schematically depicted in FIG. 19. Here, L=8 beats.

A repetition is stored if it meets the following criteria:

i) the repeating sections both start at a downbeat, and ii) the mean correlation value over the repetition is equal to, or larger than, 0.8.

To do this, the system may first search all possible repetitions, and then filter out those which do not meet the above conditions. The possible repetitions can first be located from the SDM by finding values which are above the correlation threshold. Then, filtering can be performed to remove those which do not start at a downbeat, and those where the average correlation value over the diagonal (m,k), (m+L−1,k+L−1) is not equal to, or larger than, 0.8.

The start indices and the mean correlation values of the repetitions filling the above conditions are stored. If greater than 500 repetitions are found at this point, only the 500 repetitions with the largest average correlation value may be stored.

Next, overlapping repetitions are removed. All pairs of overlapping repetition regions are found and only the one with the larger correlation value is retained. An overlapping repetition for the repetition (m,k), (m+L−1,k+L−1) may be defined, for example, as another repetition (p,q), (p+T−1,q+T−1) such that abs(p-m)<max(L,T) and abs(q-k)<max(L,T) and abs(p-m)=abs(q-k), where "abs" denotes the absolute value and "max" the maximum. In other words, there must be overlap between the repetitions and they must be located on the same diagonal of the SDM.

The pattern score for a downbeat corresponds to the number of repetitions found in the SDM starting at that downbeat. The score is normalised by dividing with the maximum value over all downbeats.

Stream 1606

The inputs to the sixth stream 1606 are also the beat synchronous chroma vectors obtained previously.

In this case, clustering is performed. It will be appreciated that another way to find structure in musical signals is via unsupervised clustering: feature vectors can be clustered to represent states which are used to find sections where the music signal repeats (feature vectors belonging to the same cluster are considered to be in a given state). The motivation for this is that in some cases musical sections, such as verse or chorus sections, have an overall sound which is relatively similar or homogenous within a section but which differs between sections. For example, consider the case where the verse section has relatively smooth instrumentation and soft vocals, whereas the choruses are played in a more aggressive manner with louder and stronger instrumentation and more intense vocals. In this case, features such as the rough spectral shape described by the mel-frequency coefficient vectors will have similar values inside a section but differing values between sections. It has been found that clustering reveals this kind of structure, by grouping feature vectors which belong to a section (or repetitions of it, such as different repetitions of a chorus) to the same state (or states). That is, there may be one or more clusters which correspond to the chorus, verse, and so on. The output of a clustering step may be a cluster index for each feature vector over the song. Whenever the cluster changes, it is likely that a new musical section starts at that feature vector.

The pattern score generated from stream 1606 is based on a clustering method as follows:

1) Initialize a set of clusters by performing vector quantization on the inputted chroma features, though not the beat synchronous chroma features. More specifically, take a single initial cluster; parameters of the single cluster are the mean and variance of the data (the chroma vectors measured from a track or a segment of music). Split the initial cluster to two clusters. Then, there is an iterative process wherein data is first allocated to the current clusters, new parameters (mean and variance) for the clusters are then estimated, and the cluster with the largest number of samples is split until a desired number of clusters are obtained.

To elaborate on this step, each feature vector is allocated to the cluster which is closest to it, when measured with the Euclidean distance, for example. Parameters for each cluster are then estimated, for example as the mean and variance of the vectors belonging to that cluster. The largest cluster is identified as the one into which the largest number of vectors have been allocated. This cluster is split such that two new clusters result having mean vectors which deviate by a fraction related to the standard deviation of the old cluster.

As an example, we have used a value 0.2 times the standard deviation of the cluster, and the new clusters have the new mean vectors m+0.2*s and m−0.2*s, where m is the old mean vector of the cluster to be split and s its standard deviation vector.

2) Initialize a Hidden Markov model (HMM) to comprise a number of states, each with means and variances from the clustering step above, such that each HMM state corresponds to a single cluster and a fully-connected transition probability matrix with a large self transition probability (e.g. 0.9) and a very small transition probability of switching state.

In the case of a four state HMM, for example, the transition probability matrix would become:

| | | | |
|---|---|---|---|
| 0.9000 | 0.0333 | 0.0333 | 0.0333 |
| 0.0333 | 0.9000 | 0.0333 | 0.0333 |
| 0.0333 | 0.0333 | 0.9000 | 0.0333 |
| 0.0333 | 0.0333 | 0.0333 | 0.9000 |

We have proposed using twelve states in the HMM. During clustering in 1) above, the data is clustered into twelve clusters. Each of the twelve HMM states is initialized using the mean and standard deviation of respective ones of the twelve clusters from the initialization step in 1).

3) Perform Viterbi decoding through the feature vectors using the HMM to obtain the most probable state sequence. As is known in the art, the Viterbi decoding algorithm is a dynamic programming routine which finds the most likely state sequence through a HMM, given the HMM parameters and an observation sequence. When evaluating the different state sequences in the Viterbi algorithm, a state transition penalty is used having a value of −200 or −150 when calculating in the log-likelihood domain. The state transition probability is added to the logarithm of the state transition probability whenever the state is not the same as the previous state. This penalizes fast switching between states and gives an output comprising longer segments.

The output of this step is a labelling for the feature vectors. Thus, for an input sequence of c1, c2, . . . , cN, where $c_i$ is a chroma vector at time i, the output is a sequence of cluster indices l1, l2, . . . , lN, where $1 \le li \le 12$ in the case of 12 clusters.

4) After Viterbi segmentation, the state means and variances are re-estimated based on the labelling results. That is, the mean and variance for a state is estimated from the vectors during which the model has been in that state according to the most likely state-traversing path obtained from the Viterbi routine. As an example, consider the state "3" after the Viterbi segmentation. The new estimate for the state "3" after the segmentation is calculated as the mean of the feature vectors ci which have the label 3 after the segmentation.

To give a simple example: assume two states 1 and 2 in the HMM. Further assume that the input comprises five chroma vectors c1, c2, c3, c4, c5. Further assume that the most likely state sequence obtained from the Viterbi segmentation is 1, 1, 1, 2, 2. That is, the three first chroma vectors c1 through c3 are most likely produced by the state 1 and the remaining two chroma vectors c4 and c5 by state 2. Now, the new mean for state 1 is estimated as the mean of chroma vectors c1 through c3 and the new mean for state 2 is estimated as the mean of chroma vectors c4 and c5. Correspondingly, the variance for state 1 is estimated as the variance of the chroma vectors c1 through c3 and the variance for state 2 as the variance of chroma vectors c4 and c5.

5) The Viterbi segmentation and state parameter re-estimations are repeated until a maximum of five iterations are made, or the labelling of the data does not change anymore.

6) Finally, an indication of an audio change at each feature vector is obtained by monitoring the state traversal path obtained from the Viterbi algorithm (from the final run of the Viterbi algorithm). For example, the output from the last run of the Viterbi algorithm might be 3, 3, 3, 5, 7, 7, 3, 3, 7, 12, . . . .

The output is inspected to determine whether there is a state change at each feature vector. In the above example, if 1 indicates the presence of a state change and 0 not, the output would be 0, 0, 0, 1, 1, 0, 1, 0, 1, 1, . . . .

The output from the HMM segmentation step is a binary vector indicating whether there is a state change happening at that feature vector or not. This is converted into a binary score for each beat by finding the nearest beat corresponding to each feature vector and assigning the nearest beat a score of one. If there is no state change happening at a beat, the beat receives a score of zero.

Based on our experiments, this clustering score may be useful also for downbeat estimation, such that the score is used together with the system described above for downbeat estimation. This unsupervised clustering method may thus be used both in the music downbeat finding and music pattern finding steps.

Again, the pattern score is normalised and passed to the summing module 1620.

Stream 1607

This processing stream 1607 does not take as input the chroma features. This stream operates in the same way as for stream branch 1604, with the exception that it operates on the mel-frequency cepstral coefficient (MFCC) features rather than on chroma features. The MFCC features relate to timbral or spectral content of the music signal, and are useful for finding sections where the instrumentation of the song changes. For example, in pop songs the chorus is often played with a different accompaniment and even louder than the verse, for example.

Again, the pattern score is normalised and passed to the summing module 1620.

It is noted that any combination of the modules 1601, 1602, 1603, 1604, 1605, 1606, 1607 could be used in the system. That is, the system may use one, all, or a subset of these modules.

Pattern Candidate Scoring and Pattern Determination Module 605.

The summed normalised scores for each downbeat are acquired and used for identifying the music patterns of two adjacent 4/4 measures. In this embodiment, the module 605 calculates the average score for a first sequence of non-adjacent downbeats 1, 3, 5, 7 and for a second sequence of non-adjacent downbeats 2, 4, 8, 10. The sequence which has the larger average pattern score is selected as representing the start of musical patterns.

So, in this case, the output from the FIG. 16 system is a set of pattern times for the music signal, which is a subset of the downbeat times. In one implementation, pattern times correspond to every second downbeat time. In other implementations, they could be longer, for example every third or fourth downbeat, etc.

In some implementations, the pattern phase might change so that it is not possible to assign a continuous two measure grouping throughout the entire song. The present system could be extended to follow such pattern phase switches by performing pattern detection steps in windows of a few measures long. Currently, when longer tracks are processed, we look for changes in tempo and analyze the sections with nearly constant tempo separately by resetting the system state in between. Moreover, we split the sound tracks into segments of half a minute duration in maximum and reset the system state in-between. This allows the pattern phase to change between sections of nearly-constant tempo.

Variations on the above analysis method are possible. For example, instead of LDA, alternative methods could be used to score the downbeat or pattern likelihood for a beat. Examples include using a support vector machine to classify between pattern/non-pattern, or applying neural networks to perform the same. Instead of averaging the scores for the pattern candidates, the system could use other combination operations, such as summing, multiplying, or using, for example, a classifier to determine the most likely pattern from the pattern scores of a sequence of downbeats.

Practical Example—Video Angle Switches

Returning to the video processing system introduced with reference to FIGS. 4 and 5 above, a further feature is assigning probabilities to the beats in an identified pattern which determines when automatic video switches occur within the audio track.

For example, the following probabilities could be assigned:

0.7 for beat 1;

0.25 for beat 5;

0.05 for beat 8.

Figure 20:
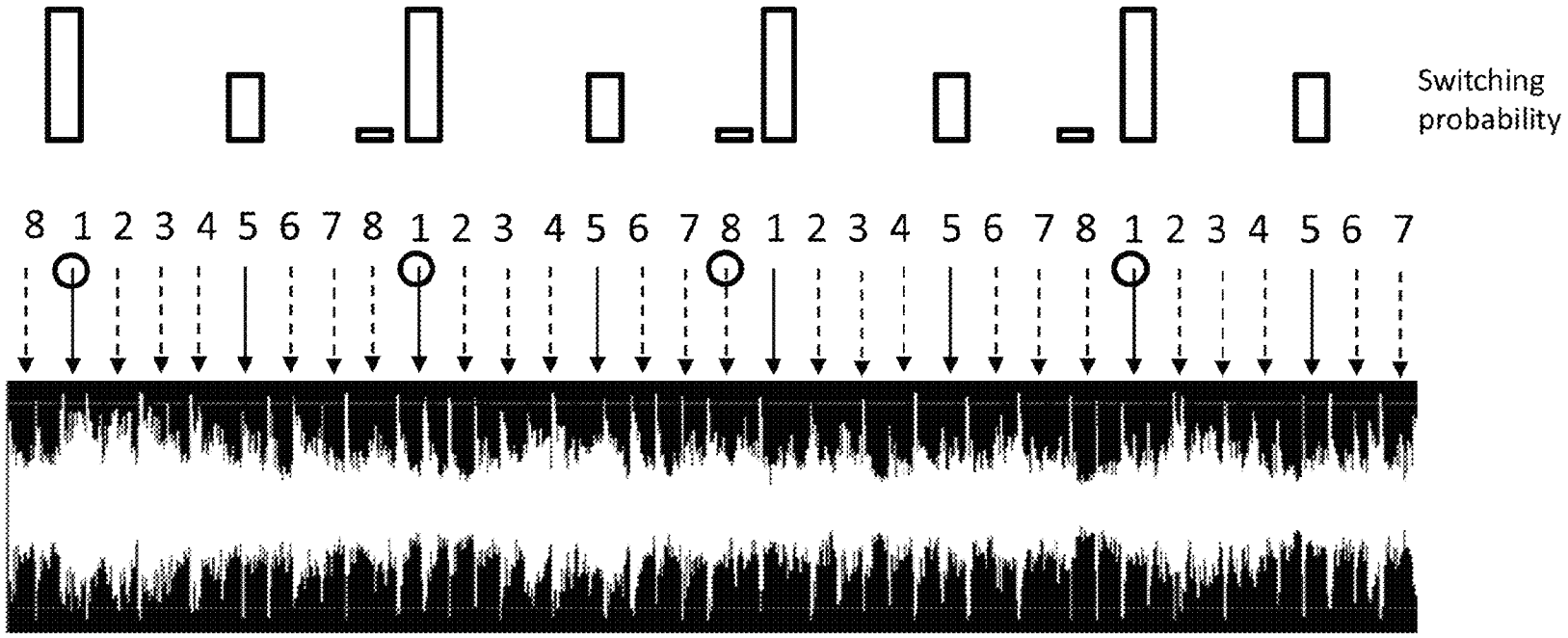
FIG. 20 is a schematic diagram of the audio signal shown in FIG. 6, with switching probabilities assigned to downbeats according to a further embodiment.

These probabilities are indicated diagrammatically in FIG. 20. In practise, this means that, on average, 70% of video angle switches happen on the first beat of an eight beat pattern, 25% on the fifth beat of the pattern, and 5% on the last beat of the pattern. In FIG. 20, the black circles indicate example switching times, which occur mostly on the first beat of an 8-beat pattern in this case.

Note that the above probabilities are example values and can be adjusted as desired and/or estimated from annotated training data of switching times.

The video processing system provided by the application 212 may analyze the soundtrack to determine the music pattern, using the FIG. 16 method, and then apply the above probabilities to come up with a sequence of switching times for the video at which to change the video angle. Such switching probabilities can also be applied to other video editing systems, automatic slideshow systems or the triggering of, e.g. dance pattern visualisations in video games or utilities.

Use of Fundamental Downbeats

In an optional enhancement to the above systems and methods, fundamental downbeats are detected, being the downbeats at the start of musical sections such as the intro, verse and/or chorus. There may be provided a special rule or rules which control the system behaviour at the fundamental downbeats. Examples include always forcing a video angle switch, triggering a different visualisation, always changing the image in an automatic slideshow, adding a prominent effect such as a white flash to a visualisation and so on.

Other Applications

In addition to video editing, the FIG. 16 method and system can be applied in music remixing. For example, a seamless transition between musical tracks in a music player could be implemented by estimating the tempo and music patterns in both tracks, time-aligning the beats and patterns during a transition period via methods of time-stretching, and then performing a cross-fade between tracks. In conventional systems, where beats and possibly downbeats are used, the addition of using music patterns would create better quality in terms of providing seamless track switches as the beginnings of musical phrases would be aligned. A similar usage is envisaged also for the fundamental downbeats.

Also the automatic music looping method presented in US Patent Application 20070261537 would benefit from such music pattern analysis. The user could be allowed to loop music patterns in the music player, such that he or she would be able to experience musical phrases in a convenient way. It was observed when developing a system related to this referenced system that sometimes single music measures are too short to be looped and a pattern of two measures would be more suitable.

It will be appreciated that the above described embodiments are purely illustrative and are not limiting on the scope of the invention. Other variations and modifications will be apparent to persons skilled in the art upon reading the present application.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

The invention claimed is:

1. A method comprising:

identifying beat time instants in an audio signal;

identifying downbeats occurring at beat time instants, each downbeat corresponding to the start of a musical bar or measure; and identifying two or more adjacent bars or measures containing musical characteristics which repeat within the audio signal by:

generating for each of a plurality of the downbeats a score using an analysis method for indicating a characteristic within the audio signal at the downbeat;

providing different sequences, e.g. S1, S2, of non-adjacent downbeats e.g. S1=1, 3, 5, 7 and S2=2, 4, 8, 10;

identifying based on the scores for each sequence the sequence that most likely corresponds to the start of a musical pattern; and selecting the downbeats of the sequence that most likely corresponds to the start of the musical pattern.

2. The method according to claim 1, wherein generating for each of a plurality of the downbeats a score using an analysis method for indicating a characteristic within the audio signal at the downbeat further comprises:

generating a plurality of scores for each downbeat using a respective analysis method for indicating different characteristics within the audio signal at the downbeat; and combining the scores for each downbeat, wherein identifying based on the score non-adjacent downbeats that correspond to the start of a musical pattern is based on the combined scores.

3. The method according to claim 1, wherein the method further comprises:

calculating an average or a product of the score or combined scores for the downbeats in each sequence; and selecting the downbeats of the sequence which has a largest average or product.

4. The method according to claim 1, wherein generating for each of a plurality of the downbeats a score using an analysis method for indicating a characteristic within the audio signal at the downbeat comprises generating the score using a classifier or function configured to indicate a likelihood that a beat corresponds to a pattern or non-pattern.

5. The method according to claim 4, wherein the method further comprises using linear discriminate analysis (LDA) at or between beat time instants by using templates trained to discriminate between beats at the start of a musical pattern and other beats.

6. The method according to claim 5, wherein generating for each of a plurality of the downbeats a score using an analysis method for indicating a characteristic within the audio signal at the downbeat comprises generating a chord change likelihood value from the audio signal and applying LDA to said value.

7. The method according to claim 5, wherein generating for each of a plurality of the downbeats a score using an analysis method for indicating a characteristic within the audio signal at the downbeat comprises extracting chroma accent features from the audio signal and applying LDA to said features.

8. The method according to claim 1, generating for each of a plurality of the downbeats a score using an analysis method for indicating a characteristic within the audio signal at the downbeat comprises generating the score by:

creating a self distance matrix (SDM) between chroma features extracted from the audio signal; and correlating the SDM with a predetermined kernel to derive a novelty score indicative of structural changes for each downbeat.

9. The method according to claim 1, wherein generating for each of a plurality of the downbeats a score using an analysis method for indicating a characteristic within the audio signal at the downbeat comprises generating the score by:

creating a SDM between chroma features extracted from the audio signal; and identifying repetition regions therein which start at a location of a downbeat in the SDM, the score being derived based on a number of repetitions for which the mean correlation value is equal to, or larger than, a predetermined number.

10. The method according to claim 1, wherein generating for each of a plurality of the downbeats a score using an analysis method for indicating a characteristic within the audio signal at the downbeat comprises generating the score by:

extracting chroma accent vectors from the signal;

allocating the chroma accent vectors to one of a predetermined number of clusters;

determining for each cluster of the predetermined number of clusters whether or not an audio change is present based on parameters of the associated chroma accent vectors; and allocating to each downbeat a score based on a number of the chroma accent vectors, temporally local to the downbeat, having a determined audio change.

11. The method according to claim 10, wherein allocating the chroma accent vectors to one of a predetermined number of clusters comprises:

initially assigning the chroma accent vectors to one of an initial set of clusters based on a distance measure;

splitting a cluster having a largest number of chroma accent vectors into two vectors; and repeating the splitting step until the predetermined number of clusters is reached.

12. An apparatus comprising at least one processor and at least one memory including computer program code for one or more programs, the at least one memory and the computer program code configured to, with the at least one processor, cause the apparatus to:

identify beat time instants in an audio signal;

identify downbeats occurring at beat time instants, each downbeat corresponding to the start of a musical bar or measure; and identify two or more adjacent bars or measures containing musical characteristics which repeat within the audio signal by the apparatus being further caused to:

generate for each of a plurality of the downbeats a score using an analysis method for indicating a characteristic within the audio signal at the downbeat;

provide different sequences, e.g. S1, S2, of non-adjacent downbeats, e.g. S1=1, 3, 5, 7 and S2=2, 4, 8, 10;

identify based on the scores for each sequence the sequence that most likely corresponds to the start of a musical pattern; and select the downbeats of the sequence that most likely corresponds to the start of the musical pattern.

13. The apparatus according to claim 12, wherein the apparatus caused to generate for each of a plurality of the downbeats a score using an analysis method for indicating a characteristic within the audio signal at the downbeat is further caused to:

generate a plurality of scores for each downbeat using a respective analysis method to indicate different characteristics within the audio signal at the downbeat; and combine the scores for each downbeat, wherein the apparatus caused to identify based on the score non-adjacent downbeats that correspond to the start of a musical pattern is further caused to identify based on the combined scores the non-adjacent downbeats that correspond to the start of a musical pattern.

14. The apparatus according to claim 13, wherein the apparatus is further caused to:

calculate an average or a product of the score or combined scores for the downbeats in each sequence; and select the downbeats of the sequence which has a largest average or product.

15. The apparatus according to claim 12, wherein the apparatus caused to generate for each of a plurality of the downbeats a score using an analysis method for indicating a characteristic within the audio signal at the downbeat is further caused to generate the score using a classifier or function configured to indicate a likelihood that a beat corresponds to a pattern or non-pattern.

16. The apparatus according to claim 15, wherein the apparatus is further caused to use linear discriminate analysis (LDA) at or between beat time instants by being further caused to use templates trained to discriminate between beats at the start of a musical pattern and other beats.

17. The apparatus according to claim 16, wherein the apparatus caused to generate for each of a plurality of the downbeats a score using an analysis method for indicating a characteristic within the audio signal at the downbeat is further caused to generate a chord change likelihood value from the audio signal and applying LDA to said value.

18. The apparatus according to claim 16, wherein the apparatus caused to generate for each of a plurality of the downbeats a score using an analysis method for indicating a characteristic within the audio signal at the downbeat is further caused to extract chroma accent features from the audio signal and applying LDA to said features.

19. The apparatus according to claim 12, wherein the apparatus caused to generate for each of a plurality of the downbeats a score using an analysis method for indicating a characteristic within the audio signal at the downbeat is further configured to generate the score by being caused to:

create a self distance matrix (SDM) between chroma features extracted from the audio signal; and correlating the SDM with a predetermined kernel to derive a novelty score indicative of structural changes for each downbeat.

20. The apparatus according to claim 12, wherein the apparatus caused to generate for each of a plurality of the downbeats a score using an analysis method for indicating a characteristic within the audio signal at the downbeat is further caused to generate the score by being caused to:

create a SDM between chroma features extracted from the audio signal; and identify repetition regions therein which start at a location of a downbeat in the SDM, the score being derived based on a number of repetitions for which the mean correlation value is equal to, or larger than, a predetermined number.

21. The apparatus according to claim 12, wherein the apparatus caused to generate for each of a plurality of the downbeats a score using an analysis method for indicating a characteristic within the audio signal at the downbeat is further caused to generate the score by being further caused to:

extract chroma accent vectors from the signal;

allocate the chroma accent vectors to one of a predetermined number of clusters;

determine for each cluster of the predetermined number of clusters whether or not an audio change is present based on parameters of the associated chroma accent vectors; and allocate to each downbeat a score based on a number of chroma accent vectors, temporally local to the downbeat, having a determined audio change.

22. The apparatus according to claim 21, wherein the apparatus caused to allocate the chroma accent vectors to one of a predetermined number of clusters is further caused to:

initially assign the chroma accent vectors to one of an initial set of clusters based on a distance measure;

split a cluster having the largest number of chroma accent vectors into two vectors; and repeat the splitting step until the predetermined number of clusters is reached.

* * * * *